US006512909B2

(12) United States Patent
Ozawa et al.

(10) Patent No.: US 6,512,909 B2
(45) Date of Patent: Jan. 28, 2003

(54) IMAGE FORMING PROCESS AND APPARATUS AND CONTROL METHOD THEREOF

(75) Inventors: Yoshio Ozawa, Mie (JP); Eiji Ochiai, Mie (JP); Shoichi Sakata, Mie (JP)

(73) Assignee: Kyocera Corporation, Kyoto (JP)

( * ) Notice: Subject to any disclaimer, the term of this patent is extended or adjusted under 35 U.S.C. 154(b) by 36 days.

(21) Appl. No.: 09/922,003

(22) Filed: Jul. 31, 2001

(65) Prior Publication Data

US 2002/0018672 A1 Feb. 14, 2002

(30) Foreign Application Priority Data

| | | |
|---|---|---|
| Aug. 3, 2000 | (JP) | 2000-236126 |
| Sep. 29, 2000 | (JP) | 2000-300481 |
| Sep. 29, 2000 | (JP) | 2000-300482 |
| Oct. 11, 2000 | (JP) | 2000-311024 |
| May 29, 2001 | (JP) | 2001-161395 |

(51) Int. Cl.[7] ..... G03G 15/09

(52) U.S. Cl. ..... 399/270; 399/267; 399/272; 399/265; 399/266

(58) Field of Search ..... 399/119, 258, 399/259, 262, 265, 266, 267, 270, 272

(56) References Cited

U.S. PATENT DOCUMENTS

| | | | | |
|---|---|---|---|---|
| 3,866,574 A | | 2/1975 | Hardennrook et al. | |
| 5,063,875 A | | 11/1991 | Folkins et al. | |
| 5,179,414 A | * | 1/1993 | Bhagat | 399/258 |
| 6,289,194 B1 | * | 9/2001 | Endo et al. | 399/258 |

FOREIGN PATENT DOCUMENTS

| | | |
|---|---|---|
| JP | 60-106808 | 6/1985 |
| JP | 02-187770 | 7/1990 |
| JP | 03-113474 | 5/1991 |
| JP | 07-72733 | 3/1995 |
| JP | 11-231652 | 8/1999 |

OTHER PUBLICATIONS

Hosaka, et al. "Some Theoretical Analyses and Experiments on Touch–down Development"—Toshiba Research & Development Center Toshiba Corporation, May 2, 1980, pp. 44–51.

* cited by examiner

*Primary Examiner*—Hoang Ngo
(74) *Attorney, Agent, or Firm*—Hogan & Hartson, LLP

(57) ABSTRACT

When image formation is performed by an apparatus comprising: a magnetic roll for generating a magnetic brush by carrier having toner adhering triboelectrically thereto, a developer roll on the surface of which a thin layer of the toner supplied by the magnetic brush is formed, and a photoreceptor onto which the toner of thin layer jumps selectively in accordance with the latent image thereon; positively chargeable toner of which charge amount is controlled in 5~20 $\mu$C/g is used, the surface potential of the photoreceptor is set to a range above 0 to 250 V, and the after exposure potential which is the potential right after the photoreceptor is exposed is in a range of 0~ to 100 V.

15 Claims, 8 Drawing Sheets

FIG. 7

| Embodiment Example / Comparison Example | Photoreceptor Surface Potential | Photoreceptor Potential After Exposure | Developer Roll DC Potential | Magnetic Roll DC Potential | Initial Image | | | After Printing 50,000 sheets | | |
|---|---|---|---|---|---|---|---|---|---|---|
| | | | | | Density | Toner QM | Ghost | Density | Toner QM | Ghost |
| Embodiment Example 1 a - Si | 250V | 10V | 50V | 200V | 1.40 | 10 μC/g | ○ | 1.35 | 12 μC/g | ○ |
| Embodiment Example 2 a - Si | 200V | 5V | 50V | 250V | 1.45 | 10 | ○ | 1.40 | 12 | ○ |
| Embodiment Example 3 OPC | 250V | 90V | 100V | 300V | 1.35 | 12 | ○ | 1.32 | 13 | ○ |
| Embodiment Example 4 OPC | 200V | 50V | 100V | 300V | 1.40 | 10 | ○ | 1.35 | 12 | ○ |
| Comparison Example 1 a - Si | 500V | 20V | 300V | 500V | 1.50 | 19 | △ | 1.40 | 25 | × |
| Comparison Example 2 OPC | 700V | 120V | 400V | 700V | 1.50 | 20 | △ | 1.45 | 25 | × |
| Comparison Example 3 -OPC | 700V | 120V | 400V | 700V | 1.50 | -20 | × | 1.30 | -35 | × |

FIG. 8

| | Surface Potential of Developer Roll During Non-Image-Forming Period (Vdc1) | Surface Potential of Magnetic Roll During Non-Image-Forming Period (Vdc2) |
|---|---|---|
| Embodiment Exmple A | 0V (Alternating Voltage not applied) | 0V |
| Comparison Exmple A | 50V (Alternating Voltage applied) | 200V |
| Comparison Exmple B | 200V (Alternating Voltage not applied) | 50V |

FIG. 9

Result of Evaluation

| | Initial | | | 100 sheets | | | 1000 sheets | | |
|---|---|---|---|---|---|---|---|---|---|
| | Density | Ghost | Fog | Density | Ghost | Fog | Density | Ghost | Fog |
| Embodiment Exmple A | ○ | ○ | ○ | ○ | ○ | ○ | ○ | ○ | ○ |
| Comparison Exmple A | ○ | ○ | ○ | ○ | △ | ○ | △ | × | ○ |
| Comparison Exmple B | ○ | ○ | ○ | ○ | ○ | △ | ○ | ○ | × |

IMAGE FORMING PROCESS AND APPARATUS AND CONTROL METHOD THEREOF

BACKGROUND OF THE INVENTION

1. Field of the Invention

The present invention relates to an image forming apparatus such as copying machine, printer, facsimile, and combination of these using electrophotographic process, and more particularly concerns an image forming apparatus adopting a non-contact development method, wherein two component developer utilizing a magnetic carrier to charge non-magnetic toner is used, only charged toner is held on a developer roll(donor roll), and the electrostatic latent image on an electrostatic latent image carrier(hereafter referred to as photoreceptor) is developed by allowing the toner to jump thereto.

2. Description of the Related Art

Non-contact development methods have been studied as a means for developing with single component developer. Through the years, they have been studied for high speed image forming apparatuses, for example, for color superimposing on one drum in which a plurality of color images are formed sequentially thereon.

By color superimposing on one drum, it is possible to form a color image with little color drift by accurately superposing toner on a photoreceptor, so the methods have received attention as a technical art suitable for high quality color image forming.

An example of conventional non-contact development is disclosed in U.S. Pat. No. 3,866,574. According to the disclosure, a thin layer of non-magnetic toner is formed on a donor roll(developer roll), the roll being positioned not contacting with the photoreceptor and the toner being allowed to jump to the latent image on the photoreceptor by applying alternating voltage.

Another example of conventional non-contact developing method is disclosed in U.S. Pat. No. 3,929,098. In the disclosure, a development apparatus wherein two component developer is advanced to a donor roll using a magnetic roll and the toner is transported on to the donor roll to form a thin layer of the toner thereon is described.

In this example, two component developer is adopted, and although the formation of thin layer on the donor roll is possible, the removal of the toner on the donor roll is difficult when the charge potential of toner is high, so a strong alternating voltage is necessary to be applied for the removal of the toner. But, since the strong alternating voltage unsettles the thin layer of toner on the photoreceptor, it is not suited for color superimposition.

With the conventional arts mentioned above, the deviation of potential after exposure which is the potential of the photoreceptor right after the exposure varies largely relying on the environmental conditions. As a result, a high surface potential of the photoreceptor is required, and the potential of development electric field has been inevitably set high.

Further, the control of toner charge is complicated, and a high bias voltage(development voltage) is required for the developer roll.

Therefore, consumed region and not-consumed region of toner are developed on the developer roll, potential difference between the toner adhered to the roll and that freshly supplied thereon is easily produced resulting in a hysteresis phenomenon(memory phenomenon), that is, a phenomenon in which the ghost image of the preceding image development appears superposed on the present image.

Still further, since negatively chargeable toner is generally used in the conventional arts, there has been a tendency that, when the toner is repeatedly exposed to a high electric field, the potential difference between the charge potential of the toner in a development region and that of the toner in a non-development region increases, especially in low temperature, low humidity environment. As a result, the tendency has been toward occurrence of conspicuous ghost image.

To prevent the occurrence of hysteresis phenomenon, an apparatus having a member for scraping the developed toner on the developer roll and a device for recovering scraped toner, is disclosed in Japanese Unexamined Patent Publication No.11-231652. But, the provision of the scraping member induces strong physical and electrical stress in the toner, which causes the deterioration of the toner.

Further, a so-called powder cloud development process is proposed in Japanese Unexamined Patent Publication No.3-113474. This powder cloud development enables color superimposition without unsettling the developed toner by providing an auxiliary electrode composed of wires between a donor roll and a photoreceptor and applying a weak alternating voltage to the auxiliary electrode. But, with this art, the auxiliary electrode is liable to be contaminated, and there is a tendency that image degradation occurs when the wires vibrate.

Theoretical investigation made on the formation of thin layer of toner on a developer roll in a touchdown development using two component developer is described in the Journal of Institute of Electrophotography, vol.19, No.2 (1981), pp.44–51.

But, with the touchdown development, the replacement of the remaining developed toner with supply toner is not easy, and a selective development phenomenon might occur resulting in a low development performance.

Further, in Japanese Unexamined Patent Publication No.7-72733, a method of stabilizing toner charge by recovering the toner on a developer roll onto a magnetic roll through reversing the polarity of the potential difference between the developer roll and the magnetic roll during the intermediate zone between copying of one sheet and subsequent one, is described. But, when the polarity of the potential difference is inverted, the charge of the toner changes and so-called "fog" might occur.

Further, in said Journal of Institute of Electrophotography is disclosed a drawing shown in FIG. 10 in which toner supply capability $\theta$ is defined as $\theta=n\cdot(Vm/Vd)$, and is described that the toner supply capability can be increased by increasing the peripheral speed Vm of the magnetic brush of the magnetic roll relative to the peripheral velocity Vd of the developer roll.

According to U.S. Pat. No. 5,063,875, the peripheral speed of the magnetic roll is set to 2 to 5 times faster than that of the developer roll, and according to Japanese Unexamined Patent Publication No.11-231652, the speed ratio is set to 2 to 3.

However, there have been problems that, when the peripheral speed of the magnetic roll is increased relative to that of the developer roll, the rotation torque of the magnetic roll rotating with magnetically attracting carrier thereon increases, deterioration of the carrier is accelerated by collisions of carrier granules thmselves, the toner impinges on the regulating blade for regulating the height of magnetic brush and scatters resulting in lessened transported amount of toner to the developer roll side and w increased agitation of toner which increases Q/M of toner(the charge of toner per unit mass). As result, the electric adhesion force of the toner to the developer roll is increased resulting in decreased toner quantity jumping onto the photoreceptor. Accordingly, sufficient image density can not be obtained.

In particular, in a color image forming apparatus in which a plurality of colors are superimposed by arranging a plurality of photoreceptors and development devices in sequence in the transfer direction of recording medium (recording sheet or intermediate transfer member), there is a time lag between the time the image transfer start position on the recording medium reaches the preceding photoreceptor and the time the same reaches the succeeding photoreceptor for color superimposition.

Although to compose the apparatus so that the start position of each color superimposition coincides, is possible by retarding the mechanical driving of the succeeding photoreceptor and development device, construction and control becomes complicated. In addition, in the case of a high speed apparatus, there is a time lag until the specified speed is reached, and a high-level technique is required to allow the photoreceptor and developer roll to reach the specified speed in a short time.

To eliminate the time lag until the mechanical driving speed of succeeding photoreceptors and development devices reach the specified speed is possible by starting the mechanical driving of the succeeding photoreceptors and development devices at the same time with the first photoreceptor and development device and controlling so that the development on the succeeding photoreceptors starts in synchronism with the image transfer start position of the recording medium.

However, when the driving of the succeeding development devices are started at the same time with the first development device, the magnetic rolls also start rotation at the same time, and so the agitation of the toner increases which causes high Q/M of toner(charge of toner per unit mass), increase of the electric adhesion force of the toner to the developer roll, decrease of the amount of toner jumping to the photoreceptor. Accordingly, sufficient image density can not be obtained.

SUMMARY OF THE INVENTION

The present invention is made in the light of the circumstances described above. An object of the invention is to provide an image forming apparatus of non-contact development using two component developer and a control method thereof, wherein sharp images can be formed evading the occurrence of "fog" and suppressing the occurrence of ghost image.

Another object of the invention is to provide a control method of an image forming apparatus capable of obtaining a sufficient image density without increasing agitation of the toner in development devices.

According to the present invention, when image formation is performed by an apparatus comprising a magnetic roll for generating a magnetic brush of carrier having toner adhering triboelectrically thereto, a developer roll on the surface of which a thin layer of the toner supplied by the magnetic brush is formed, and an electrostatic latent image carrier (photoreceptor) onto which the toner of thin layer jumps selectively in accordance with the latent image thereon; positively charged toner of which the amount of charge is controlled in a range of 5~20 $\mu$C/g is used, a surface potential of the photoreceptor is in a range above 0 to 250 V, and an after exposure potential which is a surface potential right after the photoreceptor is exposed to light is in a range of 0~100 V.

If the surface potential of the photoreceptor is higher than 250 V, the charge amount of thin layer of the toner formed on the developer roll increases. As a result, tendency has been toward increased potential difference between the charge potential of the toner and the potential in non-developed region resulting in a more conspicuous ghost image. For this reason, the present invention limits the surface potential of the photoreceptor in a range above 0 to 250 V.

The inventors found that, when the after exposure potential is equal or below 100 V under a condition of surface potential in a range above 0 to 250 V, the charge amount of positively charged toner is easily controlled in a range of 5~20 $\mu$C/g, and the generation of "fog" can be suppressed while keeping development performance.

The after exposure potential can be controlled by the energy of exposure.

Further, in the present invention, the toner remaining on the developer roll is recovered by a magnetic brush in the non-image-forming period after the time of an image formation until the start of subsequent image formation (including the period before the start of image formation) in the case of consecutive formation of a plurality of images.

The potential difference between the developer roll and magnetic roll is eliminated to obtain an equal potential state. By eliminating the difference of bias voltage through producing an equal potential state, the electrostatic force with which the toner is adhered onto the developer roll is eliminated. As a result, the toner remaining on the developer roll is efficiently recovered onto the magnetic roll by magnetic brush effect due to the peripheral speed difference between the developer roll and magnetic roll. The replacement of toner is easily performed by recovering the remaining toner from the developing roll and supplying fresh toner to the same. For this reason, a thin layer of toner of even thickness can be formed on the developer roll and the remaining toner which causes a ghost image to occur can be easily recovered.

Thus, sharp images can be formed by evading the occurrence of "fog" and suppressing the occurrence of ghost image.

Further, in the present invention, the peripheral speed of the magnetic roll is set a range of 1.1 to smaller than 2.0 times the peripheral speed of the developer roll.

As the ratio of the surface speed of the magnetic roll to the developer roll is in a range of 1.1 to smaller than 2.0, reduction of the toner developed on the photoreceptor due to the increase of the electrostatic adhesion force of the toner to the developer roll by the increase of Q/M of toner (electrostatic charge of toner per unit mass) is prevented, and sufficient density of images can be obtained.

According to the present invention, the faster the peripheral speed of the magnetic roll than that of the developer roll, the more the chance of contact of the magnetic brush with the developer roll, and in addition, the shearing stress exerting on the toner remaining on the developer roll through the magnetic brush increases. As a result, the recovery of the remaining toner is performed more effectively. In particular, when the peripheral speed ratio of the magnetic roll to developer roll is set to 1.5 to smaller than 2.0, the substantial distinction of ghost image is impossible, thus the ghost image preventive effect is more distinguished.

BRIEF DESCRIPTION OF THE DRAWINGS

FIG. 7 is an evaluation chart 1 showing the result of evaluation of ghost image.

FIG. 8 is a chart showing surface potential of developer roll and magnetic roll in non-image-forming period.

FIG. 9 is an evaluation chart 2 showing the result of evaluation of "fog".

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 6:
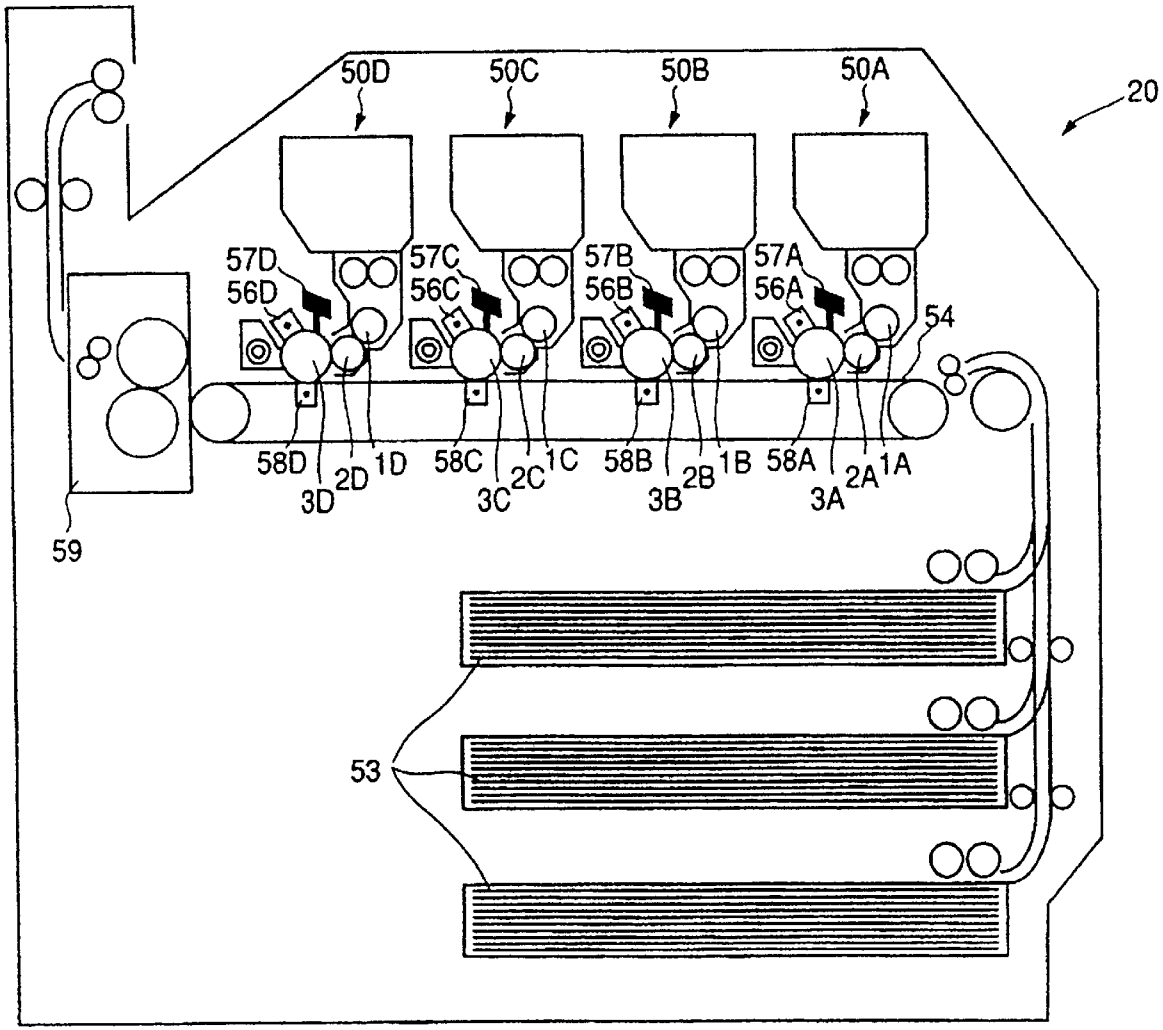
FIG. 6 is a diagrammatic illustration showing the configuration of an embodiment of the image forming apparatus according to the present invention.
Figure 10:
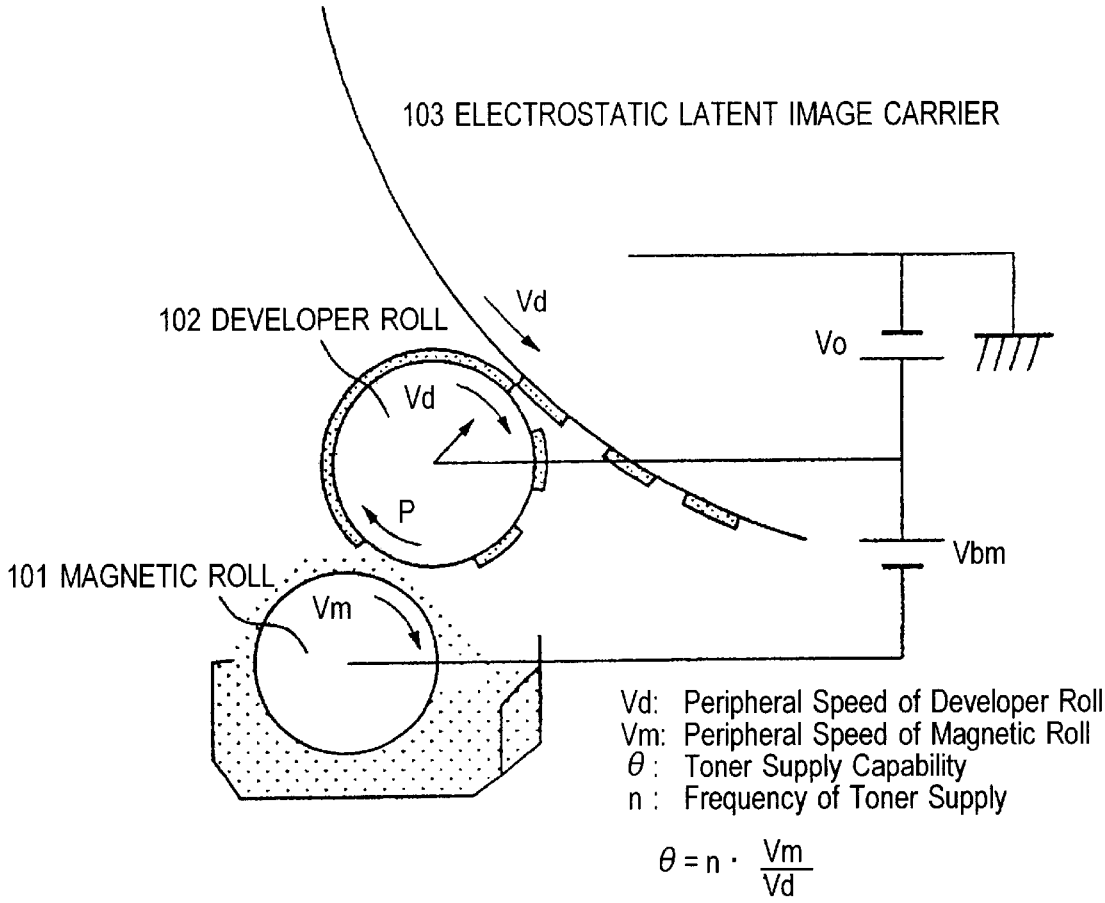
FIG. 10 is a diagrammatic illustration for explaining the relation between the peripheral speed Vd of developer roll and the peripheral speed Vm of the magnetic brush of magnetic roll.

First, the configuration of an embodiment of the image forming apparatus to be controlled will be explained upon reference to FIG. 6. In the drawing, an endless belt 54 is provided in the image forming apparatus 20 so that it can transfer recording sheets from a paper cassette 53 toward a fusing device 59.

A black development device 50A, a yellow development device 50B, a cyan development device 50C, and a magenta development device 50D are disposed over the belt 54 for transferring recording sheets.

In each of these development devices 50 is arranged each of magnetic rolls 1A~1D, and each of developer rolls 2A~2D adjacent to each of the magnetic rolls. Photoreceptors 3A~3D each is disposed facing each of the developer rolls 2A~2D. On the periphery of each of the photoreceptor 3A~3D is located each of static charger 56A~56D and each of exposure devices 57A~57D.

When a print start signal from a control circuit not shown in the drawing is received, carrier granules and toner particles are agitated and the toner particles are triboelectrically charged to be adhered to the surfaces of the carrier granules. So, a magnetic brush of carrier having toner adhering thereto is formed on the surface of each of the magnetic rolls 1A~1D, and a thin layer of toner is formed on the surface of each of the developer rolls 2A~2D.

Charging of each of the photoreceptor 3A~3D by each of the static charger 56A~56D, and latent image formation on each of the photoreceptor 3A~3D by the exposure of image signals from each of the exposure devices 57A~57D are so carried out so that a recording sheet sent out from the paper cassette 53 onto the belt 54 reaches each of the photoreceptors 3A~3D just in time for transferring the developed image on each of the photoreceptor 3A~3D to the sheet.

The latent image on each of the photoreceptors 3A~3D is developed by the toner on each of the developer rolls 2A~2D, and when the recording sheet reaches each of the photoreceptors 3A~3D, transfer bias is applied by each of transfer devices 58A~58D to transfer the toner image on each of the photoreceptors 3A~3D to the recording sheet. The toner image on the recording sheet is fused by the fusing device 59 and ejected.

Next, the working of the photoreceptor 3, and the magnetic roll 1 and developer roll 2 in the development device 50 will be explained with reference to FIG. 1.

Figure 1:
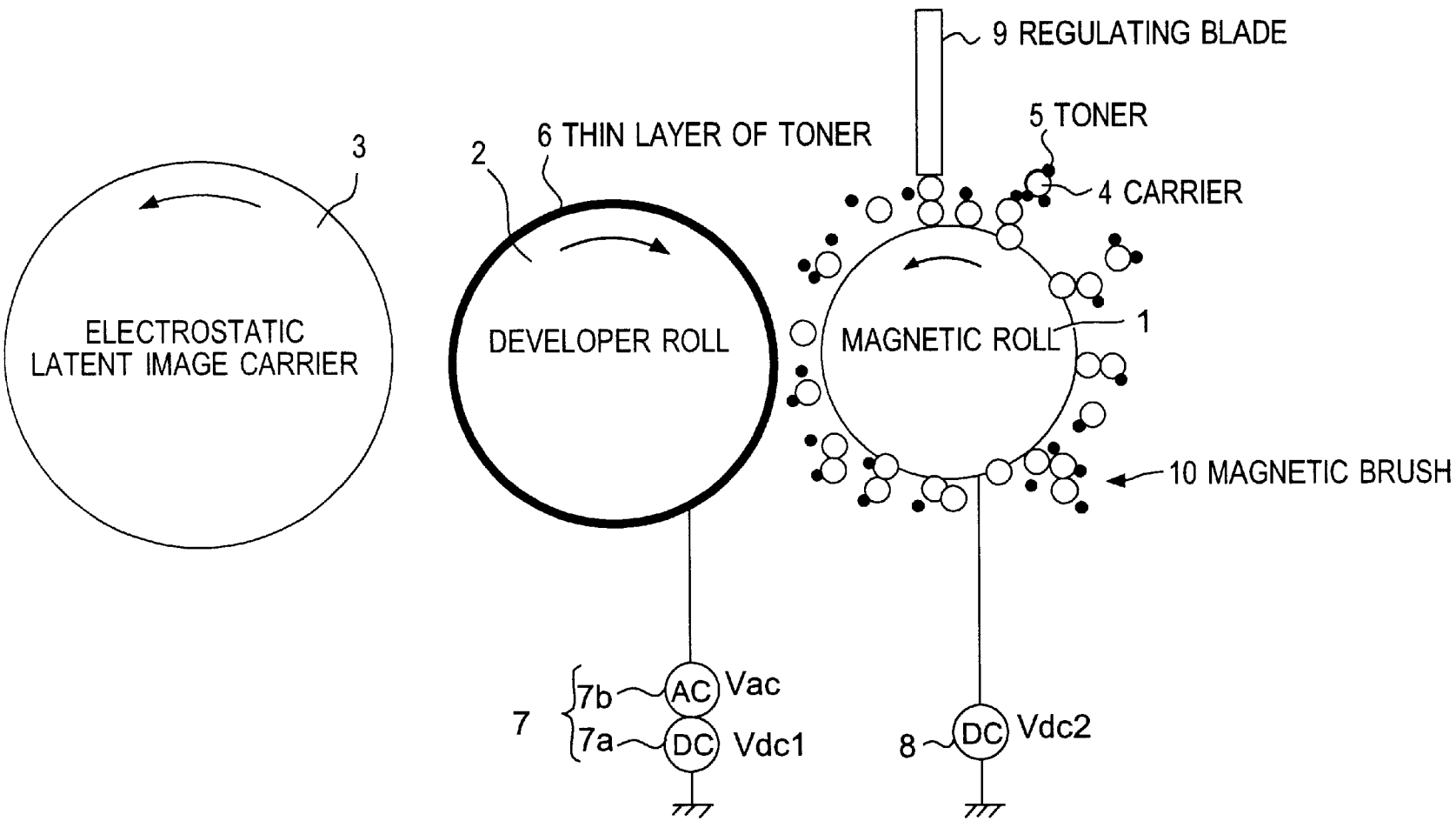
FIG. 1 is a diagrammatic illustration showing the essential part of the image forming apparatus.

The essential par of the embodiment of the image forming apparatus comprises a magnetic roll 1 of diameter of about 20 mm, a developer roll 2 of diameter of about 20 mm, and a photoreceptor 3, as shown in FIG. 1.

The magnetic roll 1 allows the formation of a magnetic brush 10 composed of carrier granules 4 having toner 5 adhering triboelectrically thereto.

A thin layer 6 of toner 5 supplied from the magnetic brush 10 is formed on the surface of the developer roll 2.

The electrostatic fields generated by the latent image on the photoreceptor attract the toner from the carrier so as to develop the latent image.

The electrostatic latent image carrier 3 has a photoreceptor of thickness of 10~25 $\mu$m including photosensitive layer of amorphous silicone on the surface.

Figure 2:
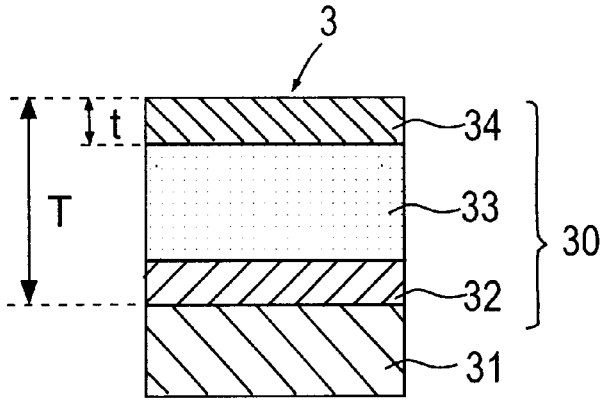
FIG. 2 is an enlarged partial sectional view of the photoreceptor.

An enlarged partial section of the electrostatic latent image carrier member 3 is shown in FIG. 2. As shown in FIG. 2, the photoreceptor 3 has a laminated construction with a blocking layer 32, a photosensitive layer 33 of amorphous silicone(a-Si), and a surface protecting layer 34 laminated one after another on a base material 31. The thickness of the photoreceptor 30 refers to thickness T which is the sum of the thickness of the blocking layer 32, photosensitive layer 33 and surface protecting layer 34. Therefore, the electrostatic latent image carrier 3 means the photoreceptor 30.

The material of the photosensitive layer is not particularly limited as far as it is amorphous silicone. Among amorphous silicone are, for example, a-Si, a-SiC, a-SiO, a-SiON, etc.

The thickness t of the surface protecting layer 34 is 0.3~5 $\mu$m. A material having specific ratio of Si(silicone) and C(carbon) contents among a-SiC is desirable for the surface protecting layer 34. Among such a-SiC, a-$Si_{(1-x)}C_x$ ($0.3 \leqq X < 1.0$) is preferable, and further, a-$Si_{(1-x)}C_x$ ($0.5 \leqq X < 0.95$) is more preferable. The reason is that, such a-SiC has a specifically high resistance of $10^{12}$~$10^{13}$ Ω·cm, and a superior saturation charge potential, resistance to wear property, and resistance to adverse environmental conditions (resistance to moisture) can be obtained.

In the embodiment, positively charged toner is used as toner 5. The surface potential of the photoreceptor is set to above 0 to 250 V, and the after exposure potential which is the potential right after the exposure of the photoreceptor to light by a laser scanner or LED is in a range of 0~100 V.

An electrical power source consisting of a first DC source 7*a* fore applying bias voltage Vdc1 in a range of 0~200 V and an alternating source 7*b*, is provided between the photoreceptor and developer roll. The alternating electrical power source 7*b* applies alternating voltage of which the peak voltage Vpp is 500~2000V and the frequency f is 1~3 kHz.

The bias voltage Vdc1 is lower than the surface potential of the photoreceptor and higher than the potential after exposure.

The photoreceptor 3 is grounded. So, bias voltage of substantial 0~200 V is applied between the photoreceptor 3 and developer roll 2 by the DC electrical power source 7*a*.

Although, in the embodiment, the photoreceptor 3 is grounded and bias voltage Vdc1 is applied by applying the voltage to the developer roll 2, the method of applying bias voltage Vdc1 is not limited to this one.

In the case a determined voltage is applied to the photoreceptor 3, bias voltage Vdc1 is the potential difference between the determined voltage and the voltage applied to the developer roll 2. So, it is suitable to apply a DC voltage so that the potential difference is in a range of 0~200 V.

Further, a second DC electrical power source 8 is provided for applying voltage Vdc2 to the magnetic roll 1. The voltages of the first and second DC source 7*a* and 8 are determined so that potential difference |Vdc2−Vdc1| between the developer roll 2 and magnetic roll 1 is 100~350 V. Here, for example, it is suitable to set as; Vdc2=250 V, Vdc1=100V, resulting in |Vdc2−Vdc1|=150 V.

Figure 3:
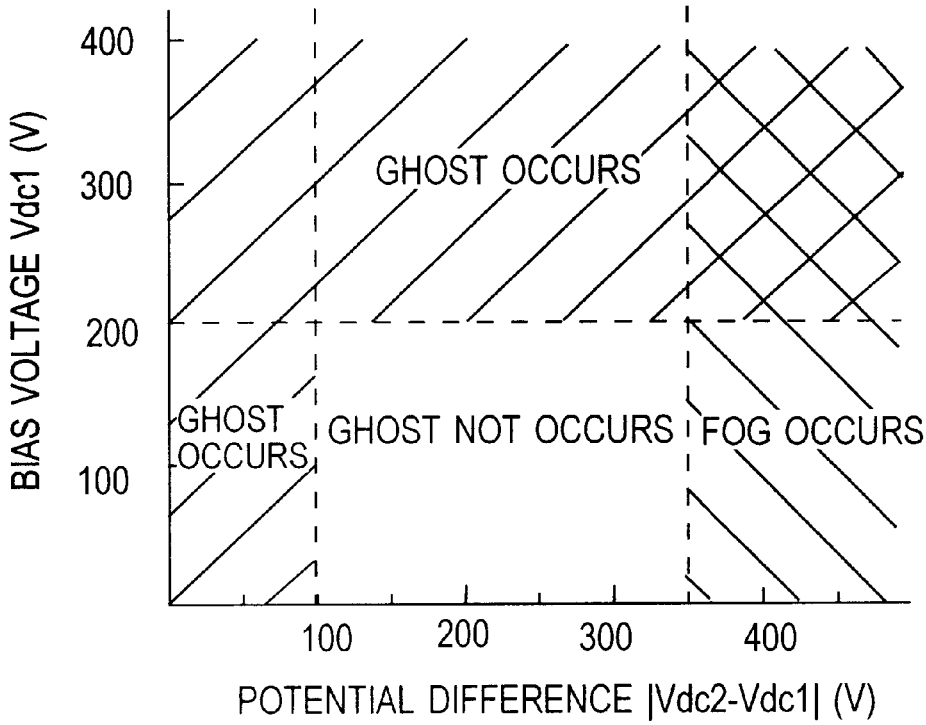
FIG. 3 is a graph showing the relation between development conditions and development characteristics.

Here, the relation between development characteristics, bias voltage Vdc1, and potential difference |Vdc2−Vdc1| will be explained upon reference to a graph of experimental result in FIG. 3. The abscissa of the graph in FIG. 3 represents potential difference |Vdc2−Vdc1| and the coordinate represents bias voltage Vdc1. When bias voltage Vdc1 is higher than 200 V, a ghost image occurs. When potential difference |Vdc2−Vdc1| is lower than 100V, also a ghost image occurs. On the other hand, when |Vdc2−Vdc1| is higher than 350V, "fog" occurs.

Therefore, it is recognized from FIG. 3 that images of high quality can be obtained when bias voltage Vdc1 is in a range of 0~200 V and at the same time potential difference |Vdc2−Vdc1| is in a range of 100~350 V, where 0 V is not included in Vdc1.

Again returning to FIG. 1, developer material consisting of carrier granules 4 and toner particles 5 is agitated to charge the toner 5 to a proper static charge level.

The developer forms a magnetic brush 10 around the periphery of the magnetic roll 1. The magnetic brush 10 is regulated to a certain thickness on the magnetic roll 1 by passing a regulating blade 9 and contacts with the developer roll 2.

Here, the gap between the regulating blade 9 and magnetic roll 1 is regulated to 0.3~1.5 mm. The gap between the magnetic roll 1 and developer roll 2 is also set to be 0.3~1.5 mm.

The gap between the developer roll 2 and photoreceptor 3 is set to 50~400 μm, preferably to 200~300 μm.

When a thin layer 6 of toner is formed on the developer roll 2 under the conditions of gap and voltage application mentioned above, the thickness of the thin layer 6 of toner is 10~50 μm. The developer roll 2 is rotated with a peripheral speed of 72 m/s and the magnetic roll 1 is rotated with peripheral speed 1.8 times faster than that of the developer roll 2.

As a result, owing to the brushing effect by the difference of the peripheral speeds, remaining toner on the developer roll 2 after development is replaced easily by supply toner. By this effect, ghost image occurrence is suppressed and a sharp image can be developed on the photoreceptor 3.

Further, the carrier granule 4 used in the embodiment is composed of a carrier core granule having magnetism and a coating layer containing macromolacular polyetylene resin formed on the surface thereof by polymerization. The carrier core granule has microscopic asperities(bumps and dips) on the surface.

The coating layer on the surface of the carrier core granule is composed of macromolacular polyetylene of average molecular weight above 50000 grown by polymerization by inducing ethylene gas after the asperities are allowed to hold ethylene polymerizing catalyst.

It is desirable that the carrier 4 has a resistance of $10^8$~$10^{12}$ Ω·cm and a saturation magnetic charge of 60~100 emu/g. When the resistance of carrier is below $10^8$ Ω·cm, carrier development and "fog" might occur. On the other hand, when it exceeds $10^{12}$ Ω·cm, there might occur degradation of image such as decrease of image density.

It is suitable that the resistance is measured by such a manner in which a carrier layer of thickness of 0.5 cm and of 1 kg load sandwiched between two electrodes of area of 5 $cm^2$ is provided and a voltage of 1~500 V is placed between the upper and lower electrodes to measure the electric current flowing across the electrodes. The resistance is calculated from the applied voltage and measured current.

Further, it is preferable that the coating layer on the surface of carrier core granule contains hydrophobic silica, or magnetic powder and/or fine particles of resin at least in the outermost layer thereof.

This kind of carrier 4 has extremely high strength and durability. By using the carrier of this kind, a stable thin layer of charged toner can be formed on a developer roll without deterioration of the surface of carrier even with repeated use.

Accordingly, accurate development of image on a photoreceptor is made possible. Further, substantially no carrier replacement is required during the life of a development device because of the high durability of carrier.

Hereinbelow, examples of carrier and developer material are explained cocretively.

I. Carrier

1. Carrier Core Material (1) Material

Among materials used as carrier core granule are public known materials as carrier for two component developer for electrophotography, for example, a metal such as ferrite, magnetite, iron, nickel, and cobalt, or an alloy or mixture of these metals and metals such as copper, zinc, antimony, aluminum, magnesium, selenium, tungsten, zirconium, vanadium, etc., or a mixture of ferrite, etc. with metal oxides such as iron oxide, titan oxide, magnesium oxide, etc., nitrides such as chrome nitride, vanadium nitride, etc., and carbides such as silicone carbide, tungsten carbide, etc., a ferromagnetic ferrite, and a mixture of them.

In particular, ferrite with saturation magnetism of 60~100 emu/g is desirable.

(2) Shape

Magnetic granules having microscopic asperities are preferable as carrier core material. The diameter is not specifically limited, granules of diameter of 20~100 μm can be preferably used.

If the diameter of carrier core granule is smaller than 20 μm, there might occur the adhesion of carrier to the photoreceptor 3 due to the jumping of the carrier. On the other hand, if the diameter is larger than 100 μm, carrier striation might be developed resulting in the degradation of image quality.

(3) Proportion of Carrier Core

The proportion of carrier core material is set to equal or above 95% in weight of the carrier. This proportion indirectly determines the thickness of the resin layer of the carrier. If the proportion is below 95%, the coating layer becomes excessively thick, and the durability and charge stability required for developer material can not be sufficed due to the peeling-off of the coating layer and increase of the amount of electric charge, etc. Also, there occur such problems that the reproducibility of narrow lines is deteriorated and image density is lowered.

As to the upper limit, there is not specific limitation. The coating is done to a degree the carrier core granule is completely covered with the resin layer. The proportion is different according to the properties of the carrier core material and method of coating. If the proportion of the carrier core material is too high, the flowability of carrier is extremely deteriorated and uniform charging of toner is impossible.

(4) Conduction Layer

An electric conductive layer can be provided on a carrier core granule as needed before the coating of macromolacular ethylene. As a conductive layer formed on a carrier core granule, a proper resin layer in which, for example, electric conductive fine particles are dispersed can be adopted. The formation of such conductive layer brings about the effect of obtaining a sharp image with high density and high contrast. It is thought that this is effected through the balancing of the leak and accumulation of charge due to the proper decrease in electric resistance.

Among electric conductive fine particles for forming the conductive layer are carbon black such as carbon black, acetylene black, etc., carbide such as SiC, etc., magnetic powder such as magnetite, $SnO_2$, ZnO, $TiO_2$, and titan black, etc.

Among proper resin for forming conductive layer are, for example, a variety of thermoplastic resin such as polystyrene group resin, polyacryl(methacryl) group resin, polyolefin group resin, polyamide group resin, polycarbonate group resin, polyether group resin, polysulphonic asid group resin, polyester group resin, epoxy group resin, polybutylal group resin, urea group resin, urethaneurea group resin, silicone group resin, teflon group resin, etc., mixture of these resin, copolymer of these resin, block polymer, graft polymer of these resin, and polymer blend, etc.

The conductive layer can be formed by coating a solution of a proper resin in which the conductive fine particles are dispersed by a spray coating method, dipping method, etc. It can also be formed by kneading core granules, conductive particles, and resin.

Also, it can be formed by polymerizing monomers on the surface of core granule with the conductive fine particles thereon. As to the size and amount of conductive particle, there is no limitation so long as the characteristics such as electric resistance, etc. of the carrier of the embodiment are sufficed. As to the size of conductive fine particle, the diameters of particles with which the particles can be dispersed uniformly in the resin solution are suitable, concretely, average diameter of 2~0.01 $\mu$m is suitable, preferably 1~0.01 $\mu$m is more suitable.

As to the amount of conductive fine particles added, the proper value differs according to the kind of the particle and can not be determined unconditionally. However, percentage of its content in the resin layer is suitable to be 0.1~60%wt, preferably to be 0.1~40%wt. In particular, when consecutive copying of narrow lines is done using a carrier of which the proportion of carrier core is as small as about 90%wt and the coating layer is relatively thick, reproducibility deteriorates. This problem can be solved by the addition of the conductive fine particles.

The carrier with function layer such as conductive fine particles formed thereon may be also referred to as carrier core granule hereafter.

2. Coating Layer of Macromolecular Polyethylene (1) Molecular Weight

Macromolecular polyethylene is generally simply called polyethylene. Polyethylene of average molecular weight above fifty thousands, further above hundred thousands is preferable for use in the embodiment. Generally, polyethylene of average molecular weight below fifty thousands such as wax, etc. is discriminated from macromolecular polyethylene resin used in the embodiment.

Polyethylene wax is soluble in hot toluene and capable of being coated by conventional penetration method or spray method, however, because of its weak adhesion to the carrier core material, it tends to peel off from the core with use for a prolonged period due to shear stress experienced in the development device.

It is suitable to add more than one kind of function particle such as the said conductive fine particles or fine particles as described later having a charge regulating function.

(2) Formation of Coating Layer

As coating method, polymerization method is adopted because of high strength and resistance to exfoliation. The polymerization method refers to a method of producing polyethylene resin coated carrier by polymerizing ethylene on the surface of a carrier core granule treated with polymerizing catalyst.

For the formation of coating layer of polyethylene resin are used highly active catalyst component containing titan and/or zirconium and being soluble in hydrocarbon solvent (e.g. hexane, heptane, etc.), a contact product obtained by contacting the catalyst component beforehand with carrier core material, and an organoalumimum compound. Core granules are suspended in the hydrocarbon solvent, and ethylene monomer is supplied to be polymerized on the surfaces of the core granules.

When conductive fine particles or fine particles having a charge control function is to be added, they may be added when macromolecular polyethylene resin coating layers are formed.

By this method, polyethylene layer is directly formed on the surface of a carrier core granule, so the obtained film has high strength and durability.

When the function particles such as conductive fine particles or fine articles having a charge control function are dispersed in the polymer in this way, the function particles are taken into the layer as the macromolecular polyethylene resin layer grows, and the macromolecular polyethylene resin film containing the function particles is formed.

The amount of macromolecular ethylene coating is desirable to be in weight ratio; (carrier core granule)/(macromolecular polyethylene coating)=99/1~95/5.

More than a kind of function particles such as conductive fine particles or fine particles having a charge control function can be added as mentioned above to modify the carrier.

Among the conductive fine particles to be added and dispersed in the macropolyrthylene resin coating are public known substances, for example, conductive magnetic powder such as carbon black, magnetite, etc., $SnO_2$, titan black, etc.

Average diameter of carrier core granules is desirable to be in a range of 0.01~5.0 $\mu$m.

(3) Outermost Layer

The coating layer can control toner charge by having at least an outermost layer containing hydrophobic silica and magnetic powder and/or fine particle of resin. The hydrophobic silica is used not alone but together with magnetic powder and/or fine particle of resin in order to prevent outside additives from spending out the function of the function layer.

By composing the carrier like this, the electrostatic adhesion of outside additives due to the change in charging performance of hydrophobic silica is prevented, and charge-up of the carrier is suppressed by the discharge effect of the magnetic powder, which further ensures the prevention of adhesion.

Further, by using two kind of fine particle different in size together, additives of 20~40 nm in size can be prevented from intruding.

The single use of hydrophobic silica brings about increase in resistance and extreme charge-up of the carrier resulting in the lost of function of the carrier.

① Hydrophobic Silica

Among hydrophobic silica used in the embodiment are, for example, silica surface treated to be given hydrophobicity and rendered positively or negatively chargeable. Its primary grain diameter is preferable to be equal or smaller than 40 nm, 10~30 nm is more preferable. With a diameter larger than 40 nm, gap between each of silica particles becomes large and bumps and dips are developed on the surface of carrier.

The percentage of its content in the outermost layer is preferable to be 50 phr(%wt ratio of additive to coating layer), 20~30 phr is more preferable. RA200HS of Japan Aerozil, and 2015 EP, 2050EP of Workerchemicals are commercially available as positively chargeable silica. As negatively chargeable silica, R812, RY200 of Japan Aerozil, and 2000, 2000/4 of Workerchemicals are available. It is preferable that negatively chargeable silica is added for the toner to be positively charged and positively chargeable silica is added for the toner to be negatively charged.

② Magnetic Powder

Among powder used in the embodiment are, for example, magnetite, ferrite, iron powder, etc.

Grain size is preferable to be 0.1~1 μm, more preferable to be 0.2~0.7 μm.

If it is smaller than 0.1 μm, the effect as a spacer becomes lost, and if it is larger than 1 μm, its addition to the outermost layer could become impossible. As to the percentage of its content, 50 phr or smaller is preferable, 20~30 phr is more preferable. As to electric resistance, $1\times10^{7}$~$10^{10}$ Ω·cm is preferable, $1\times10^{7}$~$1\times10^{9}$ Ω·cm is more preferable.

When it is smaller than $1\times10^{7}$ Ω·cm, the powder could have conductivity and become unchargeable.

When it is larger than $1\times10^{10}$ Ω·cm, local charging could occur resulting in the lack of function as magnetic powder.

Triiron tetraoxide A, triiron tetraoxide B of Mitsui metal Co., etc. are commercially available.

③ Fine Particle of Resin

Among fine particles of resin used in the embodiment are, for example, the following negative chargeable resin (A) and positive chargeable resin (B).

(A) Negative Chargeable Resin

Fluororesin(e.g. vinylidene fluoride resin, ethylene tetrafluoride resin, ethylene chloride trifluoride resin, copolymer of ethylene tetrafluoride~ethylene hexafluoride), vinyl chloride group resin, and celluloid.

(B) Positive Chargeable Resin

Acrylic resin, polyamide group resin(e.g. nylon-6, nylon-6.6, nylon-11, etc.), styrene group resin(polystyrene, ABS, AS, AAS etc.), vinylidene chloride resin, polyester group resin(e.g. polyethylene terephtalate, polyethylene naphtalate, polybutylene terephtalate, poliacrylate, polyoxibenzoyl, polycarbonate, etc.), polyether group resin (polyacetal, polyphenylene ether, etc.), ethylene group resin (EVA, EEA, EMAA, EAAM, EMMA, etc.).

Particle diameter of 0.1~1 μm is preferable, 0.2~0.7 μm is more preferable.

If it is smaller than 0.1 μm, the formation of positive charged particle is difficult and preferable effect can not be obtained. If it is larger than 1 μm, addition as positively charged particle becomes difficult.

As to the percentage of its content in the total outermost layer, 50 phr or lower is preferable, 20~30 phr is more preferable.

It is preferable to add negatively chargeable resin for the toner to be charged positive, and positively chargeable resin for the toner to be charged negative.

It is permissible to contain either one or both of the magnetic powder and fine particles of resin. Further, the magnetic powder and fine particles of resin may be of a kind or a plurality of kinds.

④ Thickness of Layer

The thickness of the outermost layer is preferable to be 0.1~6 μm, because, if it is thinner than 0.1 μm, the coating could be incomplete, on the other hand, if it is thicker than 6 μm, the exfoliation of the outermost layer could occur by the mechanical shock from outside due to friction etc.

⑤ Formation of Outermost Layer and its Fixation

As to the method of forming and fixing the outermost layer of the carrier used in the embodiment, single or combined method of the following two methods can be used.

(i) A loosening crusher of sealed type Henshel Mixer (FM10L type of Mitsui-Miike Machinery make) or the like which utilizes mechanical impact for fixation is used and polyethylene resin coating on the carrier core granule is smoothed for proper receiving the fine particle components.

Subsequently, proper amount of hydrophobic silica, and magnetic powder and/or fine particles of resin are mixed to form the outermost layer. The amount of hydrophobic silica, and magnetic powder and/or fine particles of resin are determined according to the absolute value of charge amount to be changed and stability of real print image. If the surface smoothing of the coated layer for properly receiving the fine particle components is not done before addition of the fine particle components, the additives concentrate on the bumps and dips on the surface, and exfoliation of the coating layer occurs.

To be concrete, in general the fine particle components are added in the proportion of 0.1~50 phr to the amount of polyethylene coating of the macromolecular polyethylene coated carrier after the surface of carrier is smoothed. However, with consideration given to durability, the change of resistance in the process of growing of the outermost layer, and production stability, a proportion of 20~30 phr. is appropriate.

The treatment by the Henshel Mixer is done in a range of treatment amount of 1~5 kg and with such a low rotation speed that added hydrophobic silica, magnetic powder, and fine particles of resin do not scatter.

The treatment time differs according to the added amount of hydrophobic silica, magnetic powder and/or fine particles of resin, and macromolecular polyethylene to be coated. However, treatment for 0.5~5 hrs. is necessary. When fixing the hydrophobic silica, and magnetic powder and/or fine particles of resin by mechanical impact, dust(various kinds of fine particles) emerges, so particle size classifying must be done sufficiently.

(ii) A heat spheroidizing device (Hosokawa Co. make) and the like which applies heat for spheroidization and fixation is used to form the outermost layer by mixing macromolecular polyethylene coated carrier, appropriate amount of hydrophobic silica, and magnetic powder and/or fine particles of resin. The amount of hydrophobic silica, and magnetic powder and/or fine particle of resin are determined according to the absolute value of charge amount to be changed and stability of real print image.

In general, the fine particle components are added in the proportion of 0.1~50 phr to the amount of polyethylene coating of the macromolecular polyethylene coated carrier after the surface of carrier is smoothed. However, with consideration given to durability, the change of resistance in the process growing of the outermost layer, and production stability, a proportion of 20~30 phr is appropriate In the heat spheriodizing process, mixing treatment for about 1 minute by the Henshel Mixer is done in the mixing procedure to allow the hydrophobic silica, and magnetic powder and/or fine particles of resin to adhere mechanically or electrically to the surface of the macromolecular polyethylene coated carrier.

Fixation is performed by instantly heating the surface coated uniformly with the fine particle components to a temperature above melting point of the polyethylene and cooling to form and fix the outermost layer thereon.

If not heated above melting point and cooled instantly, coagulation occurs due to the melting of the coated layer. If mechanical impact is applied when the temperature is above the melting point, exfoliation of the coated layer occurs.

3. Electric Conductive Characteristic of Carrier

As to the conductivity of carrier, most appropriate value varies according to the system of development device using the carrier. In general, a carrier which shows resistance of $10^8$~$10^{12}$ Ω·cm is preferable. If the resistance is smaller than $10^8$ Ω·cm, carrier development and "fog" could occur, and on the other hand, when it exceeds $10^{12}$ Ω·cm, there could occur degradation of image such as decrease of image density.

The resistance was measured by such a manner in which a carrier layer of thickness of 0.5 cm and of 1 kg load sandwiched between two electrodes of area of 5 $cm^2$ is provided and a voltage of 1~500 V is placed between the upper and lower electrodes to measure the electric current flowing across the electrodes.

II Developer Material for Electrophotography

1. Toner

Developer material for electrophotography in the embodiment can be obtained by mixing a variety of kinds of toner with a carrier. In the embodiment, public known positively chargeable toner can be used.

The positively chargeable toner is preferable to be composed of resin and charge control agents(CCA). As resin for the purpose, a resin with monomer such as methylmethacrylate(MMA), etc. introduced into styrene-acryl copolymer, for example, can be used. As a charge control agent(CCA), $4^{th}$ class ammonium salt, nigrosine, or triphenylmethane group dyes, for example, can be used.

These positively chargeable toner can be produced by public known methods such as, for example, suspension polymerization, crushing method, micro-capsule method, spray-dry method, mechanochemical method, etc.

The charge amount of the positively chargeable toner is controlled to 5~20 μC/g by outside additives, charge control agents(CCA), resin, etc.

At least binder resin, colorant, and other additives as needed, e.g. charge control agents, lubricant, offset inhibitor, fixing improver, etc. can be mixed.

Also, the toner can be made magnetic by adding a magnetic agent, which is effective for improving development characteristics and preventing the scattering of toner in the apparatus.

Mixing of lubricant from outside is also suitable to improve fluidity. As binder resin, polystyrene such as polystyrene, styrene-butadiene copolymer, styrene-acryl copolymer, polyethylene, ethylene, vinyl acetate copolymer, ethylen fumaric-acid group resin, acrylphthalate resin, polyamide resin, polyester group resin, maleic acid resin, etc. can be used, for example.

As colorant, public known dye and pigment, for example, carbon black, phtalocyanine blue, indanthrene blue, peacock blue, permanent red, red iron oxide, alizarine lake, chrome green, Malachite Green lake, methyl violet lake, Hansa yellow, permanent yellow, titan oxide, etc. can be used.

As charge control agent, a positive charge control agent such as nigrosine, nigrosine base, triphenylmethane group compounds, polyvinyl pyridine, the $4^{th}$ grade ammonium salt, etc., and a negative charge control agent such as metallic complex salt of alkyl subatitution salicylic acid(e.g. chromic compound salt or zinc compound salt of di-tert-butyl salicylic acid), etc. can be used, for example.

As lubricant, teflon, zinc stearate, polyvinylidene fluoride, etc. can be used, for example. As offset inhibitor and fixing improver, low molecular-weight polypropylene or polyolefin wax, the denatured substance thereof, etc. can be used, for example. As a magnetic agent, magnetite, ferrite, iron, nickel, etc. can be used, for example. As a fluidizing agent, silica, titan oxide, aluminum oxide, etc can be used.

Average grain size of toner is preferable to be 20 μm or smaller, more preferable to be in a range of 3~10 μm.

2. Mixing Ratio

The proportion of toner in the embodiment is 2~40%wt to the total of the carrier and toner, preferably 3~30%wt, and more preferably 4~25%wt. When the proportion of toner is lower than 2%wt, the charge of the toner is high and sufficient image density can not be obtained. On the other hand, when it is over 40%, the charge of the toner is not sufficient, so that the toner detaches from the developer roll and is scattered in the copying machine to soil the inside thereof which causes "fog" on the image.

3. Use

The developer in the embodiment is a two component developer having charged toner on the carrier, and used in a two component developer type electrophotography system, for example, in a copying machine(analog, digital, monochrome, color), printer(monochrome, color), facsimile, etc. It is used most suitably particularly in a high speed, ultra high speed copying machine and printer, etc. in which the developer experiences high stress in the development device. The developer can be used without particular limitation concerning image forming methods, exposing methods, developing methods(devices), and a variety of control methods, by adjusting the resistance, grain size, grain size distribution, magnetic force, charge amount, etc. of the carrier and toner to the most suitable value.

Hereinbelow, examples of developer of the present embodiments will be explained.

(1) Preparation of Catalyst Component Containing Titan

Dehydrated n-heptane of 200 ml and magnesium stearate of 15 g(25 millimol) dehydrated beforehand under reduced pressure(2 mmHg(266.644 Pa)) at 120° C. were put in a flask of inside volume of 500 ml replaced with argon to be made into a slurry. While the slurry being agitated, titan tetrechloride of 0.44 g(2.3 millimol) was dropped, then heating was started, reaction was allowed under circulating flow for 1 hr. to obtain a viscous and transparent catalyst (active catalyst) solution containing titan.

(2) Evaluation of Activity of the Catalyst Component Containing Titan

Dehydrated hexane of 400 ml, triethylaluminum of 0.8 millimol, diethylaluminum chloride of 0.8 millimol, and a part of the titan containing catalyst component obtained in the process of (1) were charged as titan atom of 0.004 millimol into an autoclave of inside volume of 1 liter replaced with argon and heated to 90° C. The pressure in the system was 1.5 kg/cm$^2$G(1.5×10$^5$ Pa).

Subsequently, hydrogen was supplied. After the pressure rose to 5.5 kg/cm$^2$G(5.4×10$^5$ Pa) ethylene was supplied continuously so that the total pressure was kept to 9.5 kg/cm$^2$G(9.3×10$^5$ Pa), polymerization was done for 1 hr, and a polymer of 70 g was obtained. The polymerizing activity was 365 kg/g·Ti/Hr and MRF(melt resin fluidity at 190° C., 2.16 kg load; JISOKO 7210) of the obtained polymer was 40.

(3) Preparation of Polyethylene Coated Carrier

Sintered ferrite powder F-300(Powderbook Co. make, average grain size of 50 μm) of 960 g was charged into an autoclave of inside volume of 2 liter replaced with argon, heated to 80° C., and dried for 1 hr under reduced pressure (10 mmHg(1333.22 Pa)). Subsequently, it was cooled to 40° C., dehydrated hexane of 800 ml was added, and agitation was started.

Then, diethylaluminum chloride of 0.5 millimol, and a part of the titan containing catalyst component obtained in the process of (1) were added as titan atom of 0.05 millimol and reaction was allowed for 30 minutes. Subsequently, the temperature was risen to 90° C., and ethylene of 4 g was introduced. The inside pressure was 3.0 kg/cm$^2$G(2.9×10$^5$ Pa).

Subsequent to that, hydrogen was supplied, and after the pressure rose to 3.2 kg/cm$^2$G(3.1×10$^5$ Pa) triethylaluminum of 5.0 millimol was added and polymerization was started. The pressure inside the system lowered down to about 2.3 kg/cm$^2$G(2.3×10$^5$ Pa) in about 5 minutes and then became stable.

Then, carbon black(MA-100 of Mitsubishi Chemicals Co. make) of 5.5 g made into a slurry with dehydrated hexane 100 ml was added, subsequently polymerization was done while polyethylene being continuously supplied so that the pressure in the system was kept to 4.3 kg/cm$^2$G(4.2×10$^5$ Pa) for 45 minutes(the supply was stopped when polyethylene of 40 g was introduced in the system) giving 5.5 g of ferrite coated with polyethylene resin containing carbon.

The dried powder had evenly black color, and it was observed by an electronic microscope that the surface of the ferrite was coated lightly with polyethylene and carbon black was uniformly dispersed in the polyethylene.

The composition of this composite was measured by a TGA(thermobalance), which showed that the ratio of ferrite: carbon black: polyethylene was 95.5:0.5:4.0 (in weight).

The intermediate stage carrier thus obtained was named carrier A1. The average molecular weight of the polyethylene film measured by GPC was 206,000.

Next, carrier A1 was classified by sifting it through a sieve of 125 μm mesh, and granules of equal or larger diameter than 125 μm were removed. The carrier after classification was flowed for 10 hrs. in a fluidized layer type gas flow classifier of tower diameter of 14 cm into which heated air(115° C.) having linear velocity of 20 cm/s was introduced therein. The obtained carrier by this classification was named carrier A2.

Carrier A2 of 1000 g was put into the Henshel Mixer (FM10L of Mitsui-Miike Macinery Co. make) of capacity of 10 liters, and the surface of the carrier A2 was smoothed by applying mechanical impact through agitation. Subsequently, hydrophobic silica(R812 of Japan Aerozil Co. make) of 12 g was mixed and further mechanical impact was applied for 1 hr in the Henshel Mixer, then magnetic powder (triiron tetraoxide A of Mitsui metal Co. make) of 8 g was mixed and still further mechanical impact was applied for 1 hr in the Henshel Mixer to form the outermost layer of mixed silica and magnetic powder. Then it was sifted through the sieve to remove carrier granules of large diameter, coagulated silica, and coagulated magnetic powder. Subsequent to that, in order to remove not-fixed fine particles of silica and magnetic powder, it was treated for 2 hrs in the fluidized layer type gas flow classifier with heated air of velocity of 20 cm/s, and carrier B was obtained.

Further, carrier B was mixed with cyan toner in the ratio of 80:20 in weight to obtain the developer.

By charging toner using the carrier having superior durability and charge controllability, a thin layer having a constant charge can be formed on a developer roll, and noncontact formation of sharp images on a photoreceptor is possible.

Figure 4:
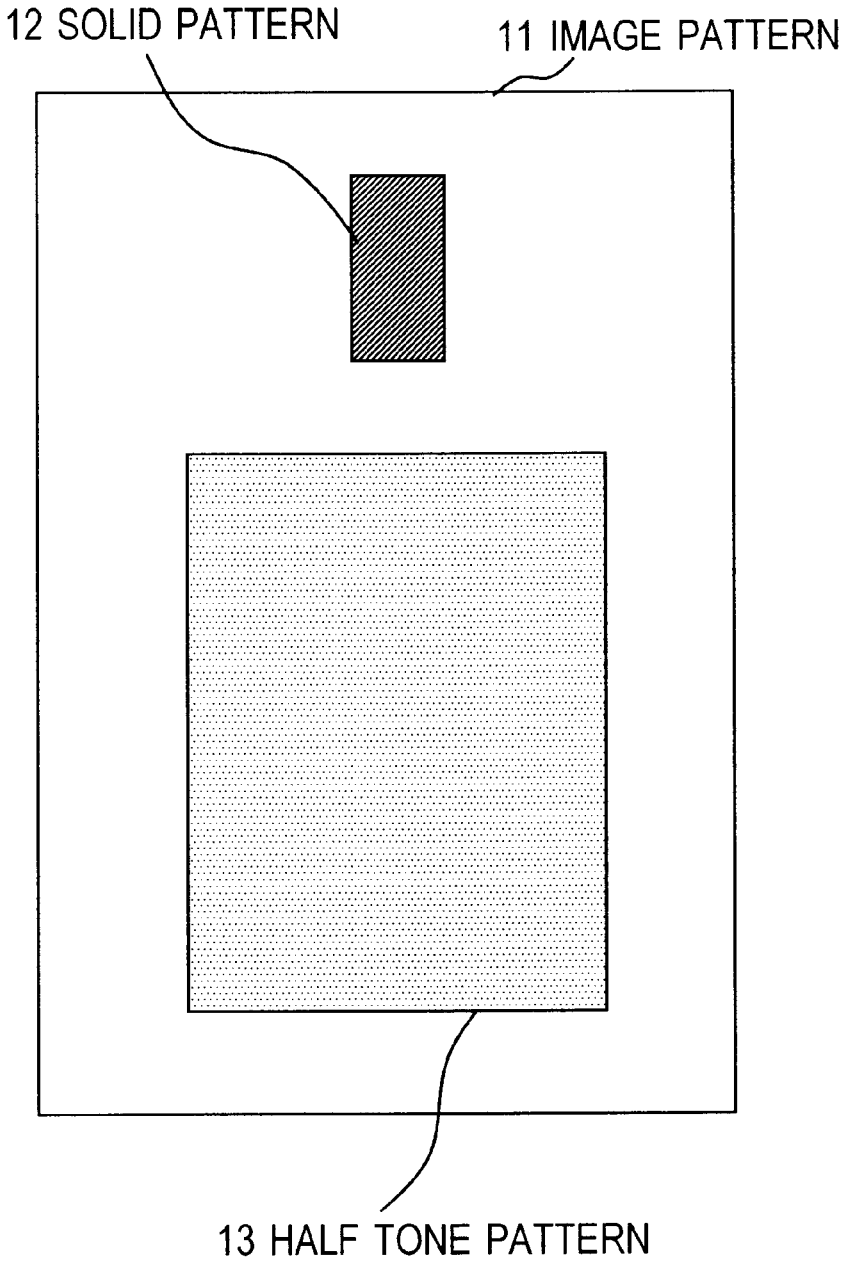
FIG. 4 is a schematic illustration of image pattern for evaluating image characteristic.

Next, in order to evaluate the effect of the embodiments, an image pattern 11 shown in FIG. 4 was formed in each of the following examples of embodiment 1~4 and examples for comparison 1~3. In the image pattern 11, a rectangular solid pattern 12 and a halftone pattern 13 larger than the pattern 12 are disposed so that the halftone pattern 13 is developed subsequent to the solid pattern 12. The image density of the halftone pattern 13 was selected to be 25% of that of the solid pattern 12. Density of 25% was selected because a ghost image is comparatively liable to appear with this density.

A FS-1750 image forming apparatus of Kyousera Co. make with development device modified was used for the evaluation. Alternating voltage having peak voltage of 1.4 kV and frequency of 2 kHz was applied between the photoreceptor 30 and developer roll 2.

For the evaluation, the image pattern 11 was formed with only the composition of photoreceptor, the surface potential of photoreceptor, the after exposure potential of photoreceptor, DC potential(Vdc1) of the developer roll 2 being varied.

The density and charge amount(QM) of toner and ghost image were evaluated for the initially printed image and that after printing 50000 sheets.

The measurement of the charge amount of toner was done using the thin layer of toner of about 1 cm$^2$ on the developer roll sucked with QM meter of Trek Co. make after printing several sheets.

Example of Embodiment 1

In example of embodiment 1, the electrostatic latent image carrier 3 with a-Si photoreceptor 30 of thickness of 15 μm was used. When forming an image, the surface potential of the photoreceptor 30 was set initially to 250 V, after exposure to 10 V, surface potential(Vdc1) of the developer roll to 50 V, and surface potential(Vdc2) of the magnetic roll to 200 V.

Example of Embodiment 2

In example of embodiment 2, the electrostatic latent image carrier 3 with a-Si photoreceptor 30 of thickness of 12 μm was used. When forming an image, the surface potential of the photoreceptor 30 was set initially to 200 V, after exposure to 5 V, surface potential(Vdc1) of the developer roll to 50 V, and surface potential(Vdc2) of the magnetic roll to 250 V.

Example of Embodiment 3

In example of embodiment 3, the electrostatic latent image carrier 3 with a positively chargeable organic photoreceptor(OPC) of thickness of 25 μm was used. When forming an image, the surface potential of the photoreceptor was set initially to 250 V, after exposure to 90 V, surface potential(Vdc1) of the developer roll to 100 V, and surface potential(Vdc2) of the magnetic roll to 300 V.

Example of Embodiment 4

In example of embodiment 4, the electrostatic latent image carrier 3 with a positively chargeable organic photoreceptor of thickness of 30 μm was used. When forming an image, the surface potential of the photoreceptor was set initially to 200 V, after exposure to 50 V, surface potential (Vdc1) of the developer roll to 100 V, and surface potential (Vdc2) of the magnetic roll to 300 V.

Example for Comparison 1

In example for comparison 1, the electrostatic latent image carrier 3 with a-Si photoreceptor 30 of thickness of 35 μm was used. When forming an image, the surface potential of the photoreceptor 30 was set initially to 500 V, after exposure to 20 V, surface potential(Vdc1) of the developer roll to 300 V, and surface potential(Vdc2) of the magnetic roll to 500 V.

Example for Comparison 2

In example for comparison 2, the electrostatic latent image carrier 3 with a positively chargeable organic photoreceptor(OPC) of thickness of 20 μm was used. When forming an image, the surface potential of the photoreceptor was set initially to 700 V, after exposure to 120 V, surface potential(Vdc1) of the developer roll to 400 V, and surface potential(Vdc2) of the magnetic roll to 700 V.

Example for Comparison 3

In example for comparison 3, the electrostatic latent image carrier 3 with a negatively chargeable organic photoreceptor(-OPC) of thickness of 20 μm was used. When forming an image, the surface potential of the photoreceptor was set initially to 700 V, after exposure to 120 V, surface potential(Vdc1) of the developer roll to 400 V, and surface potential(Vdc2) of the magnetic roll to 700 V.

Results of image formation under the development condition of examples of embodiments 1~4 and examples for comparisons 1~3 described above, are shown in FIG. 7.

In FIG. 7, mark "○" in "ghost" column indicates that a ghost image was not discerned at all in the half tone zone of the formed image pattern.

Mark "Δ" indicates that a ghost image was observed faintly on the first one round of the developer roll.

Mark "×" indicates that a ghost image was perceived clearly on the first one round of the developer roll.

Figure 5:
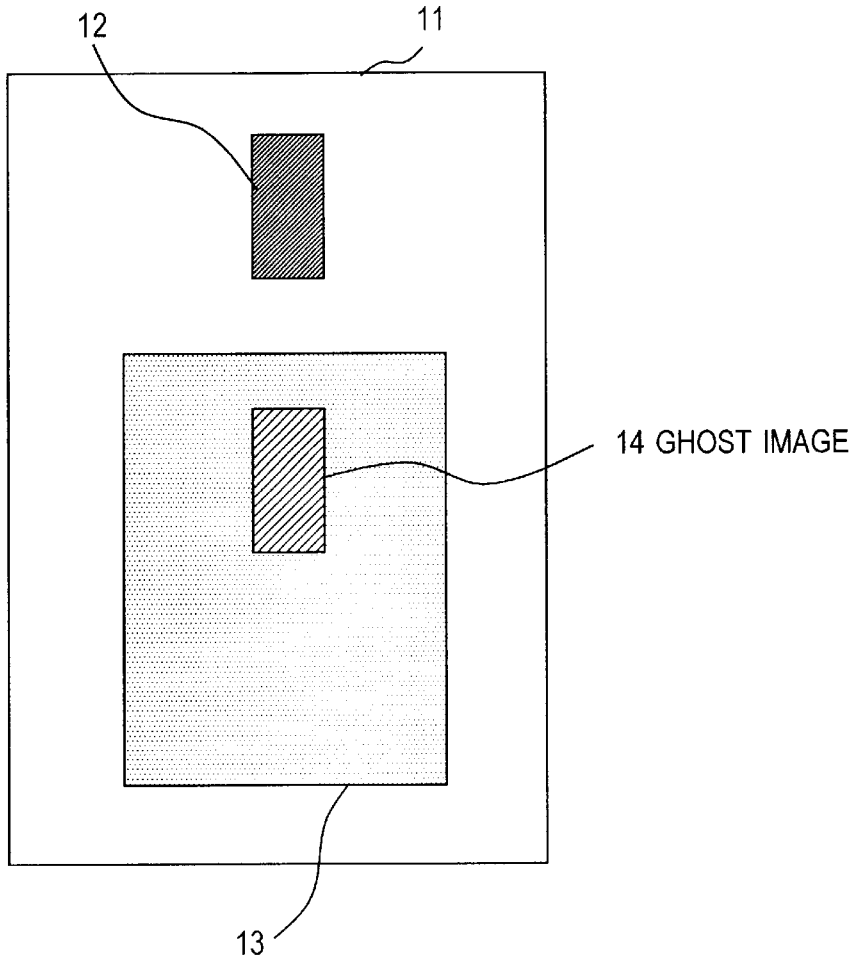
FIG. 5 is a schematic illustration showing the case in which a ghost image is appeared.

FIG. 5 depicts schematically the appearing of the ghost image of the solid pattern 12 in the zone of the half tone pattern 13 when the image pattern 11 shown in FIG. 4 was formed.

As shown in FIG. 7, in all cases of examples of embodiment 1~4, increase in the charge amount of toner image from that of initial image was small and no ghost image appeared even after printing 50 thousand sheets, and satisfactory image formation was maintained throughout the printing.

In example of embodiment 2, in spite of the low surface potential of developer roll, a relatively high image density was obtained. In examples of embodiment 3 and 4, although image density is a little lower compared to that of examples of embodiment 1 and 2, the change in toner charge was small and stable image formation was possible due to the setting of low potential of development electric field.

On the contrary, in examples for comparison 1 and 2, the charge amount of toner increased and also a ghost image appeared in both cases. In example for comparison 3, the change in toner charge was large even in comparison to example for comparison 2, and a clear ghost image appeared even in the initial image.

In the embodiment, when a plurality of images are formed consecutively, an equal potential state is produced in which the surface potential of the developer roll and that of the magnetic roll are equal during non-image-forming period after the time of an image formation until the start of the next image formation. The remaining toner on the developer roll 2 is recovered by the magnetic brush under the equal potential state.

The non-image-forming period may be, for example, determined based on the image data to be printed or, for example, determined from the position of front end or rear end of the recording sheet in the sheet feeder.

In the embodiment, the span of sheet corresponding to the non-image-forming period, i.e., the distance from the rear end of the sheet in feed for printing to the front end of the sheet for the next printing, is set to 51 mm. The diameter of the developer roll is 16 mm, so the circumference thereof is $16\pi=50.27$ mm. Accordingly, when the whole of the non-image-forming period is made into the equipotential state, the equipotential state can be continued for at least one rotation of the developer roll 2.

Next, in order to evaluate the effect of the embodiment, image density, degree of ghost image and "fog" was investigated by experiment in the case of an example of embodiment in which the surface potential of each of the developer roll and magnetic roll was set to 0 V, and two examples for comparison in which surface potential was set to different value with each other.

Image formation of the image pattern 11 shown in FIG. 4 was done in example of embodiment A and example for comparison A and B.

Example of Embodiment A

In example of embodiment A, the electrostatic latent image carrier 2 with a-Si photoreceptor 30 of thickness of 14 μwas used. When forming an image, the surface potential of the photoreceptor 30 was set initially to 200 V, surface potential(Vdc1) of the developer roll to 50 V, and surface potential(Vdc2) of the magnetic roll to 200 V. Alternating voltage having peak voltage of 1.3 kV and frequency of 2.4 kHz was applied between the photoreceptor 30 and developer roll 2. The magnetic roll 1 was rotated 1.8 times faster than the developer roll 2.

In this example of embodiment A, both of the surface voltage(Vdc1) of the developer roll 2 and that(Vdc2) of the magnetic toll 1 were set to 0 V during non-image-forming period as seen in FIG. 8 to produce equipotential state.

Example for Comparison A

In example for comparison A, equipotential state was not produced, and the equal bias voltage as that during the preceding image formation was applied continuously for subsequent image formation. That is, surface potential (Vdc1) of the developer roll 2 was set to DC 50 V and surface potential(Vdc2) of the magnetic roll 1 was set to 200 V also during non-image-forming period as shown in FIG.

8. Alternating voltage was applied between the developer roll 2 and photoreceptor 3 through image forming and non-image-forming periods.

Development conditions other than the bias voltage applied during the non-image-forming period were the same as those of example of embodiment A.

Example for Comparison B

In example for comparison B, the bias voltage was inverted in the non-image-forming period, that is, as seen in FIG. 8, surface potential(Vdc1) of the developer roll was set to DC 200V and surface potential(Vdc2) of the magnetic roller was set to DC 50 V in the non-image-forming period.

Development conditions other than the bias voltage applied during the non-image-forming period were the same as those of example of embodiment A.

The result of evaluation of image forming under the conditions of example of embodiment A and examples for comparison A and B is shown in FIG. 9. Here, image density, ghost image, and "fog" were evaluated at the initial stage, the stage when 100 sheets were printed, and when 1000 sheets were printed.

In FIG. 9, mark "○" "density" column indicates that no faint streaking is recognized in the printed image. Mark "Δ" indicates that faint streaking was recognized slightly.

Mark "○" in "ghosts" and "fog" columns indicates that a ghost image or fog was not observed in the printed image respectively. Mark "A" indicates that a ghost image or fog was slightly perceived. Mark "×" indicates respectively that a ghost image or fog was perceived clearly as shown in FIG. 5.

As recognized from FIG. 9, it was ascertained that, in example of embodiment A, faint streaking, a ghost image, and fog did not occur in each of initial stage, at the stage when 100 sheets were printed, and when 1000 sheets were printed.

On the contrary, in example for comparison A, ghost images were gradually accumulated, for the same voltage was applied during the non-image forming period and image forming period. As a result, a ghost image was slightly discerned in the stage when 100 sheets were printed, and a clear ghost was observed in the stage when 1000 sheets were printed.

In example for comparison B, although the appearing of ghost image was suppressed owing to the inversion of the bias voltage, "fog" appeared owing to the change of charge amount of toner. That is, as seen in FIG. 9, "fog" was discerned slightly at the stage when 100 sheets were printed, was clearly observed when 1000 sheets were printed.

Accordingly, it is recognized from FIG. 9 that, by producing equipotential state during non-image-forming period, formation of sharp image is possible with the appearance of ghost being suppressed while the occurrence of "fog" being evaded.

In the embodiment described above, although an example has been explained when the embodiment is configured under a specified condition, the embodiment may be modified in various configuration. For example, an example in which the equipotential state is produced during the non-image-performing period from the end of an image formation until the start of the subsequent image formation when a plurality of images are continuously formed, is explained in the above described embodiment, it is suitable in the present embodiment to produce the equipotential state before an image is formed when single image is repeatedly formed.

Further, although in the above mentioned embodiment the equipotential state was produced by setting both surface potential of the developer roll and magnetic roll to 0 V, it suffices as far as the surface potential of each of the developer roll and magnetic roll is equal and the surface potential of 0 V is not necessarily needed in the present embodiment. Foe example, when equipotential state is produced, it is suitable to set each surface potential of the developer roll and magnetic roll to 50 V.

Further, when the equipotential state is produced, the surface potential of both of the developer roll and magnetic roll may be controlled or one of the surface potential may be changed to coincide with the other one.

Further, in the embodiment mentioned above, although the equipotential state was produced over whole duration of non-image-forming period, to produce the equipotential state for the whole period is not necessarily needed. For example, a part of the non-image-forming period may be set to the equaipotential state.

Further, an experiment was done with the peripheral speed of the developer roll being 72 mm/s and that of the magnetic roll being 3 times faster than that of the developer roll. The result was that, due to the brush effect by the peripheral speed difference, the remaining toner was easily replaced with the supply toner resulting in the suppression of occurrence of ghost image and sharp image formation was possible.

In the case of color superimposition, particularly when development devices for 4 colors are arranged in the transfer direction of recording sheets as cited in the embodiment of the image forming apparatus, the development device located at the first position and succeeding ones start operation at the same time, so that the agitation time increases as the number of development devices increases.

Therefore, the influence of increase of toner agitation time to image formation was investigated.

As a result, the inventors found that, when the peripheral speed of the magnetic roll is faster than 2 times the peripheral speed of the developer roll, Q/M of toner(amount of toner charge per unit mass) becomes higher than when it is smaller than 2 times, electrical adhesion of the toner to the developer roll becomes stronger, amount of developed toner on to the photoreceptor decreases, and sufficient image density can not be obtained.

When the peripheral speed of the developer is equal to that of the magnetic roll, adhesion of toner to the surface of the developer roll varied according to manufacturing errors of constituent parts, driving speed errors, etc.

Large amounts of image formation are done in recent years and a high speed apparatus is desired, so the peripheral speed as high as possible is desirable. Therefore, the ratio of the peripheral speed of the developer roll to that of magnetic roll is desirable to be equal or larger than 1.1 and smaller than 2.

By such an art, chances the magnetic brush contacts the developer roll are increased, shearing force exerting on the remaining toner on the developer roll by the magnetic brush becomes higher, and the remaining toner can be recovered more effectively resulting in a conspicuous effect of preventing occurrence of ghost image. As a result, a ghost image was substantially not discerned in the experiment.

According to the embodiment of the present invention, when image formation is performed by an apparatus comprising; a magnetic roll for generating a magnetic brush of carrier having toner adhering triboelectrically thereto, a developer roll on the surface of which a thin layer of the toner supplied by the magnetic brush is formed, and an electrostatic latent image carrier(photoreceptor) onto which the toner of thin layer jumps selectively in accordance with the latent image thereon; positively charged toner of which the amount of charge is controlled in a range of 5~20 $\mu$C/g is used, a surface potential of the photoreceptor is in a range above 0 to 250 V, and an after exposure potential which is a surface potential right after the photoreceptor is exposed to light is in a range of 0~100 V.

If the surface potential of the photoreceptor is higher than 250 V, the charge amount of thin layer of the toner formed on the developer roll increases. As a result, tendency has been toward increased potential difference between the charge potential of the toner and the potential in non-developed region resulting in occurrence of more conspicuous ghost image. For this reason, the present invention limits the surface potential of the photoreceptor in a range above 0 to 250 V.

The inventors found that, when the after exposure potential is below 100 V under a condition of surface potential in a range above 0 to 250 V, the charge amount of positively charged toner is easily controlled in a range of 5~20 $\mu$C/g, and the occurrence of "fog" can be suppressed while keeping development performance.

The after exposure potential can be controlled by the energy of exposure.

It is desirable that, electric potential of the developer roll is set to in a range of 0~200 V, the difference of electric potential between the developer roll and magnetic roll is set to in a range 100~350 V, and alternating voltage of frequency of 1~3 kHz having peak voltage of 500~2000 V.

By lowering the bias voltage and further by setting the potential difference between the magnetic roll and developer roll to a determined value, excess charging of toner is suppressed and sharp image can be formed.

Further, the electrostatic force by which the toner is adhered to the developer roll becomes smaller due to the lower bias voltage. As a result, the remaining toner on the developer roll is recovered efficiently by the magnetic brush effect due to the peripheral speed difference of the developer roll and magnetic roll without providing a specific device such as scraping blade. As the supply of fresh toner is easily performed after recovering the remaining toner, a thin layer of toner is formed with uniform thickness, and as a result occurrence of unevenness in images can be suppressed.

Further, in the embodiment, the occurrence of ghost and fog can be suppressed by setting the potential difference between the magnetic roll and developer roll to in a range of 100~350 V based on an experiment.

In the embodiment, the development on the photoreceptor is made accurate and the recovering of the remaining toner on the developer roll is facilitated by applying alternating voltage of 1~3 kHz frequency having peak voltage of 500~2000 V based on an experiment.

Further, the thickness of thin layer of toner is preferable to be 10~50 $\mu$m.

When the thin layer of toner is excessively thick, jumping of the toner to the photoreceptor is difficult. It is generally difficult to supply toner onto the developer roll so that the thin layer of toner becomes thicker than 50 $\mu$m at one time. Therefore, if the thickness of the thin layer of toner is to be made thicker than 50 $\mu$m, unevenness in development density is apt to occur.

Further if the thin layer of toner is too thick, it becomes difficult to allow all of the toner to jump to the latent image on the photoreceptor, and a dense ghost image might occur. Moreover, if the thin layer of toner is too thick when recovering the toner, the recovering may be insufficient, which causes occurrence of the ghost image.

On the other hand, if the thin layer of toner is excessively thin, it is necessary to rotate the developer roll with higher speed to secure the toner amount needed for developing the latent image with sufficient development performance. For this reason, the thin layer of toner is preferable to be equal or thicker than 10 $\mu$m.

Further, the gap between the developer roll and photoreceptor is preferable to be 50~400 $\mu$m, more preferable to be 200~300 $\mu$m.

When the gap is narrower than 50 $\mu$m, fog is apt to occur. On the other hand, when the gap is wider than 400 $\mu$m, it becomes difficult to allow the toner to jump to the photoreceptor, and as a result sufficient image density is difficult to be obtained. Moreover, a phenomenon of selective development might be caused.

It is preferable that the photoreceptor has a photosensitive layer of the amorphous silicon and the thickness of photoreceptor is in a range of 10~25 $\mu$m.

In the embodiment, the thickness of the photoreceptor refers to the thickness from the surface of the base material of the electrostatic latent image carrier to the outermost surface thereof, not only the thickness of the photosensitive layer of the amorphous silicon.

As the thickness of the photoreceptor is decreased, saturation charge potential decrease and withstand voltage at which electric breakdown occurs decreases. On the other hand, development performance increases due to the increase of the charge density on the surface of the photoreceptor with decreasing thickness of the photoreceptor. This propensity is particularly conspicuous when the photoreceptor is thinner than 25 $\mu$m, more preferably thinner than 20 $\mu$m in the photoreceptor of amorphous silicon which has a high permitivity of about 10.

However, when the photoreceptor is thinner than 10 $\mu$m, control of potential of the photoreceptor is difficult and so-called black spot and fog are apt to occur, and further securing of needed charge potential tends to become difficult due to decreased saturation potential. Therefore, in the embodiment, the thickness of the amorphous silicon photoreceptor is determined between 10~25 $\mu$m.

With the amorphous silicon photoreceptor the after exposure potential is extremely low as 10 V or lower, so that sufficient potential difference can be obtained even if the surface potential of the photoreceptor is set to low value, which is advantageous for improving development performance.

When particularly bias voltage(bias for development) is set to a low value, saturation potential reduces by using a thin photoreceptor and withstand voltage of the photoreceptor also reduces, which causes practically no problem.

It is preferable to provide a surface protection layer of 0.3~5 $\mu$m thick on the surface of the photoreceptor.

When the surface protection layer is thinner than 0.3 $\mu$m, the saturation voltage, wear resistance, environmental resistance, etc. of the photoreceptor tend to decrease. On the other hand, when the thickness of the surface protection layer exceeds 5 $\mu$m, degradation in image is caused, and longer production time is required bringing about economical disadvantage.

It is desirable that the photoreceptor is composed of organic photoreceptor(OPC) and its thickness is in a range of 25~40 $\mu$m.

When positive chargeable organic photoreceptor is used, after exposure potential can be reduced to lower than 100V by using photoreceptor of thickness thicker than 25 μm and increasing the adding amount of charge generating material. The organic photoreceptor is desirable to be of single layer construction because the charge generating material is added.

On the other hand, when the photoreceptor is thicker than 40 μm, resolution decreases.

By the way, in a conventional image forming apparatus, the ability of charging toner varies due to the deterioration of carrier with use for a long time. For example, when 20% of the coating material on the carrier surface is peeled off, the ability of charging toner changes. As a result, unevenness of toner charge on the developer roll increases, scattering of toner and fog occur, and the image is contaminated, resulting in poor development performance, thus so-called selective development occurs.

Therefore, in the conventional image forming apparatus, it has been necessary to change the deteriorated carrier used for a determined time. But, the inconvenience of changing carrier hindered the noncontacting type image forming apparatus from coming into wide use.

The carrier used in the present invention is composed of carrier core material and a coating layer containing macromolecular polyethylene resin polymerized on the surface of the carrier core, the carrier having resistance of $10^8$~$10^{12}$ Ω·cm and saturation magnetism of 60~100 emu/g.

As charge is controlled to determined values by using resistance adjuster agent, etc. and a coating layer is formed by polymerization on the surface of carrier, extremely high strength and durability of carrier can be realized. By using carrier like this, surface deterioration of carrier is slowed down and a stable thin layer of charged toner is able to be formed on the developer roll. As a result, accurate development on the photoreceptor is made possible. Further, because of high durability of carrier, carrier needs not substantially be changed during the life of the apparatus.

It is also preferable that the carrier has fine bumps and pits on the surface, and the coating layer is composed of macromolecular polyethylene of average molecular weight larger than 50000 polymerized by introducing ethylene gas after ethylene polymerization catalyst is held on the bumps and pits.

The polymerizing process in which the surface of carrier core is treated with a ethylene polymerization catalyst and polyethylene resin coating layer is formed by direct polymerization on the surface is described, for example, in Japanese Unexamined Patent Publication No.60-106808, and No. 2-187770, etc.

According to the present embodiment, when controlling an image forming apparatus comprising: a magnetic roll for generating a magnetic brush of carrier having toner adhering triboelectrically thereto, a developer roll on the surface of which a thin layer of the toner supplied by the magnetic brush is formed, and a photoreceptor onto which the toner of thin layer jumps selectively in accordance with the latent image thereon;

a equipotential state is produced in which the surface potential of the developer roll is equal to that of the magnetic roll during non-image-forming period after the development of an image until the start of subsequent image forming(i.e., before the start of image forming) when a plurality of images are formed consecutively, and the remaining toner on the developer roll is recovered by the magnetic brush under the equipotential state.

As cited above, the surface potential of the developer roll is equalized to that of the magnetic roll to produce an equipotential state during non-image-forming period(i.e., before the start of image forming). The electrostatic force for adhering toner to the developer roll is eliminated through eliminating the bias voltage difference by producing the equipotential state. As a result, the remaining toner on the developer roll can be efficiently recovered onto the magnetic roll by the magnetic brushing effect. Then the replacement of the remaining toner with fresh one can be easily done by supplying fresh toner. In this way, a thin layer of toner of uniform thickness can be formed on the developer roll. Thus, the remaining toner which causes the occurrence of ghost is easily recovered and sharp image formation is possible while the occurrence of "fog" is evaded and the occurrence of ghost is suppressed.

It is preferable that the equipotential state is continued during at least one rotation of the developer roll.

The remaining toner is recovered over the whole circumference by rotating the developer roll more than one rotation during the equipotential state resulting in the suppression of ghost with more certainty.

In the present embodiment of the method of image forming apparatus in which the electrostatic latent image on a photoreceptor is developed by a development device, the development device has a magnetic roll which allows the formation of a magnetic brush of carrier holding toner by charging it, a developer roll on the surface of which a thin layer of toner is formed by the magnetic brush, image formation being performed by developing the electrostatic latent image on the photoreceptor with the thin layer of toner, the ratio of the peripheral speed of the developer roll to that of magnetic roll is equal or larger than 1.1 and smaller than 2, and the remaining toner on the developer roll is recovered by the magnetic brush during non-image-forming period after the development of an image until the start of subsequent image when a plurality of images are formed consecutively.

In the embodiment, the peripheral speed of the magnetic roll is 1.1 to less than 2.0 times faster than that of the developer roll, so that Q/M of the toner(charge amount of toner per mass) is high, electric adhesive force of the toner to the developer roll is high, decrease in the amount of toner developed onto the photoreceptor does not occur, and sufficient image density can be obtained.

According to the embodiment, by allowing faster peripheral speed of the magnetic roll than that of the developer roll, the chance of contact of the magnetic brush to the developer roll can be increased and at the same time the shearing force exerted by the magnetic brush on the remaining toner on the developer roll is increased resulting in weakening the adhesive force of the remaining toner to the developer roll. As a result, the remaining toner can be recovered more efficiently. Particularly, when the peripheral speed of the magnetic roll is 1.5 to less than 2.0 times faster than that of the developer roll, virtually no ghost image is discerned visually and the effect of ghost prevention is more conspicuous.

Now, to eliminate the occurrence of ghost image by the excess charge of toner due to excessively high bias voltage applied between the developer roll and photoreceptor, it is conceivable as a counter measure to reduce the bias voltage. But, by simply reducing the bias voltage, image density will not be sufficient this time and further "fog" is liable to occur, so that sharp image forming is not possible. Hereupon, the inventors hit upon the idea as a result of various experiments and discussion that if the thickness of the photoreceptor is reduced by use of amorphous silicon instead of conventional OPC(organic photoreceptor) as photoreceptor, the bias voltage can be reduced without impairment of the development performance, since the charge density of the surface of photoreceptor increases.

Therefore, an image forming apparatus of the present embodiment is an apparatus comprising a magnetic roll for generating a magnetic brush of carrier having toner adhering triboelectrically thereto, a developer roll on the surface of which a thin layer of the toner supplied by the magnetic brush is formed, and a photoreceptor onto which the toner of thin layer jumps selectively in accordance with the latent image thereon; wherein, the photoreceptor has a photoreceptor of thickness of 10~20 μm including a photosensitive layer of amorphous silicon on the surface thereof, a first DC power source for applying bias voltage of 0~200 V and a alternating power source are provided between the photoreceptor and developer roll, a second DC power source for applying voltage to the magnetic roll is provided, and the potential difference between the potential of the developer roll and that of the magnetic roller is set to 100~350 V.

As cited above, the photoreceptor is made thin, bias voltage is reduced, and further potential difference between the magnetic roll and developer roll is set to determined value. In this way, the occurrence of ghost is suppressed by suppressing excessive charging of toner, and sharp image formation is made possible.

The saturation charge potential decreases with decreasing thickness of the photoreceptor and at the same time withstand voltage reduces. On the other hand, charge density on the surface of the photoreceptor increases and development performance improves with decreasing thickness of the photoreceptor. This propensity is conspicuous when the thickness of the photoreceptor is equal or smaller than 25 μm, particularly when it is equal or smaller than 20 μm in the case of amorphous silicon photoreceptor. But when it is smaller than 10 μm, control of the potential of the photoreceptor is difficult and so-cold black spot or "fog" is liable to occur, and further saturation potential decreases resulting in tendency of becoming difficult to secure necessary charge potential.

Therefore, the thickness of the amorphous silicon photoreceptor is determined to be 10~25 μm.

As the after exposure potential of amorphous silicon photoreceptor is extremely low as below 10 V, sufficient potential difference can be produced even if the surface potential of the photoreceptor is set to low value, which is advantageous for increasing development performance.

OPC photoreceptor(organic photoreceptor) has been known as photoreceptor used in an image forming apparatus. However, the surface of OPC photoreceptor is soft, which has caused a problem that the photosensitive layer is liable to be damaged by friction with a cleaning blade. Therefore, in recent years, an amorphous silicon photoreceptor of thickness larger than 25 μm has been used which has harder surface compared to the OPC photoreceptor, and is superior in durability and maintainability of function (maintenance free). The surface film on the amorphous photoreceptor is formed by glow-discharge analyzing method, so that if the photoreceptor is thick, longer production time is required bringing about economical disadvantage.

As the bias voltage(development bias) is set to low value as 0~200 V, more preferably below 100 V, when particularly bias voltage(bias for development) is set to a low value, saturation potential reduces by using a thin photoreceptor and withstand voltage of the photoreceptor also reduces, which causes practically no problem.

Further, the electrostatic force by which the toner is adhered to the developer roll is reduced by lowering the bias voltage, which makes efficient recovery of the remaining toner on the developer roll possible by the magnetic brushing effect due to the peripheral speed difference between the developer roll and magnetic roll without providing a specific device such as scraper blade, etc. Then the replacement of the remaining toner with fresh one can be easily done by supplying fresh toner, so that a thin layer of toner of uniform thickness can be formed on the developer roll. As a result, occurrence of an irregular image is suppressed. In the embodiment, occurrence of a ghost image and "fog" can be suppressed by setting the potential difference between the magnetic roll and developer roll to 100~350 V.

The first DC power source and alternating power source apply the voltage to the developer roll. As the photoreceptor 3 is generally grounded, the voltage is applied between the photoreceptor and developer roll in this way.

On the surface of the photoreceptor is provided a surface protection layer of thickness of 0.3~5 μm.

When providing a surface protection layer on the photoreceptor, the thickness of the surface protection layer is preferable to be 0.3~5 μm. The reason is that, if the thickness is smaller than 0.3 μm, the saturation voltage, wear resistance, environmental resistance, etc. of the photoreceptor tend to decrease. On the other hand, when the thickness of the surface protection layer exceeds 5 μm, degradation of image is caused, and longer production time is required, which brings economical disadvantage.

The alternating power source applies alternating voltage of frequency of 1~3 kHz having peak voltage of 500~2000 V. By applying an alternating voltage belonging to the range cited above which was determined based on experiments, accurate development on the photoreceptor and easy recovery of the remaining toner on the developer roll are possible.

In the embodiment, the thickness of 10~50 μm of the thin layer of toner is permitted.

In the embodiment, as the bias voltage is set to low value, when the thin layer of toner is too thin, jumping of the toner to the photoreceptor is difficult. It is generally difficult to supply toner onto the developer roll so that the thin layer of toner becomes thicker than 50 μm at one time. Therefore, if the thickness of the thin layer of toner is to be made thicker than 50 μm, unevenness in development density is apt to occur. Further if the thin layer of toner is too thick, it becomes difficult to allow all of the toner to jump to the latent image on the photoreceptor, and a dense ghost image might occur. Moreover, if the thin layer of toner is too thick when recovering the toner, the recovering may be insufficient, which causes occurrence of ghost image.

On the other hand, if the thin layer of toner is too thin, it is necessary to rotate the developer roll with higher speed to secure the toner amount needed for developing the latent image with sufficient development performance. For this reason, the thin layer of toner is preferable to be equal or thicker than 10 μm.

Further, the gap between the developer roll and photoreceptor is determined to be 50~400 μm, more preferably to be 200~300 μm.

When the gap is narrower than 50 μm, fog is apt to occur. On the other hand, when the gap is wider than 400 μm, it becomes difficult to allow the toner to jump to the photoreceptor, and as a result sufficient image density is difficult to be obtained. Moreover, a phenomenon of selective development might be caused.

As detailed heretofore, according to the present invention, the occurrence of a ghost image, a so-called hysteresis phenomenon, is prevented while the occurrence of "fog" is evaded in a non-contact developing method in which the toner on the developer roll is developed on the latent image on the photoreceptor without the contact of the developer roll with the photoreceptor after a thin layer of toner of two component developer is formed on the developer roll.

Also, by the easiness of recovery of the remaining toner on the developer roll, the occurrence of ghost is suppressed while the occurrence of "fog" is evaded, and sharp image formation is possible.

What is claimed is:

1. An image forming process wherein; when image formation is performed by an apparatus comprising:

a magnetic roll for generating a magnetic brush of carrier having toner adhering triboelectrically thereto, a developer roll on the surface of which a thin layer of the toner supplied by the magnetic brush is formed, and an electrostatic latent image carrier (hereafter referred to as photoreceptor) onto which the toner of thin layer jumps selectively in accordance with the latent image thereon;

positively charged toner of which the amount of charge is controlled in a range of 5~20 $\mu$C/g is used, a surface potential of the photoreceptor is in a range above 0 to 250 V, and an after exposure potential which is a surface potential right after the photoreceptor is exposed to light is in a range of 0~100 V.

2. An image forming process according to claim 1, wherein electric potential of the developer roll is set to in a range of 0~200 V, the difference of electric potential between the developer roll and magnetic roll is set to in a range of 100~350 V, and alternating voltage of frequency of 1~3 kHz having peak voltage of 500~2000 V is applied between the developer roll and photoreceptor.

3. An image forming process according to claim 1, wherein the photoreceptor is composed of a photosensitive layer of amorphous silicon of thickness in a range of 10~25 $\mu$m.

4. An image forming process according to claim 1, wherein the photoreceptor is composed of an organic photoreceptor and the thickness of the photoreceptor is in a range of 25~40 $\mu$m.

5. An image forming process according to claim 1, wherein a carrier composed of carrier core material and a coating layer containing macromolecular polyethylene resin polymerized on the surface of the carrier core, the carrier having resistance of $10^8$~$10^{12}$ $\Omega$·cm and saturation magnetism of 60~100 emu/g.

6. An image forming process according to claim 5, wherein the carrier has fine bumps and pits on the surface, and the coating layer is composed of macromolecular polyethylene of average molecular weight larger than 50000 polymerized by introducing ethylene gas after ethylene polymerization catalyst is held on the bumps and pits.

7. A method of controlling an image forming apparatus wherein; when controlling an image forming apparatus comprising:

a magnetic roll for generating a magnetic brush of carrier having toner adhering triboelectrically thereto, a developer roll on the surface of which a thin layer of the toner supplied by the magnetic brush is formed, and a photoreceptor onto which the toner of thin layer jumps selectively in accordance with the latent image thereon;

a equipotential state is produced in which the surface potential of the developer roll is equal to that of the magnetic roll during non-image-forming period after the development of an image until the start of subsequent image forming when a plurality of images are formed consecutively, and the remaining toner on the developer roll is recovered by the magnetic brush under the equipotential state.

8. A method of controlling an image forming apparatus according to claim 7, wherein the equipotential state is continued at least during one rotation of the developer roll.

9. A method of controlling an image forming apparatus in which the electrostatic latent image on a photoreceptor is developed by a development device wherein;

the development device has a magnetic roll which allows the formation of a magnetic brush of carrier holding toner by charging it, a developer roll on the surface of which a thin layer of toner is formed by the magnetic brush, image formation being performed by developing the electrostatic latent image on the photoreceptor with the toner of thin layer, the ratio of the peripheral speed of the developer roll to that of magnetic roll is equal or larger than 1.1 and smaller than 2.0, and the remaining toner on the developer roll is recovered by the magnetic brush during non-image-forming period after the development of an image until the start of subsequent image when a plurality of images are formed consecutively.

10. An image forming apparatus comprising:

a magnetic roll for generating a magnetic brush of carrier having toner adhering triboelectrically thereto, a developer roll on the surface of which a thin layer of the toner supplied by the magnetic brush is formed, and a photoreceptor onto which the toner of thin layer jumps selectively in accordance with the latent image thereon; wherein, the photoreceptor has a photoreceptor of thickness of 10~25 $\mu$m including a photosensitive layer of amorphous silicon on the surface thereof, a first DC power source for applying bias voltage of 0~200 V and a alternating power source are provided between the photoreceptor and developer roll, a second DC power source for applying voltage to the magnetic roll is provided, and the potential difference between the potential of the developer roll and that of the magnetic roller is set to 100~350 V.

11. An image forming apparatus according to claim 10, wherein the first DC power source and the alternating power source apply voltage to the developer roll.

12. An image forming apparatus according to claim 10, wherein a surface protection layer of thickness of 0.3~5 $\mu$m is formed.

13. An image forming apparatus according to claim 10, wherein alternating voltage having peak voltage of 500~2000 V is applied with frequency of 1~3 kHz.

14. An image forming apparatus according to claim 10, wherein the thickness of the thin layer of toner is 10~50 $\mu$m.

15. An image forming apparatus according to claim 10, wherein the gap between the developer roll and electrostatic latent image carrier is 50~400 $\mu$m.

* * * * *